US005253298A

United States Patent [19]

Parker et al.

[11] Patent Number: 5,253,298

[45] Date of Patent: Oct. 12, 1993

[54] REDUCING AUDIBLE NOISE IN STEREO RECEIVING

[75] Inventors: Robert P. Parker, Westboro; William R. Short, Ashland, both of Mass.

[73] Assignee: Bose Corporation, Framingham, Mass.

[21] Appl. No.: 687,290

[22] Filed: Apr. 18, 1991

[51] Int. Cl.[5] ..... H04H 5/00

[52] U.S. Cl. ..... 381/13; 381/15

[58] Field of Search ..... 381/15, 13

[56] References Cited

U.S. PATENT DOCUMENTS

| | | | |
|---|---|---|---|
| 3,952,161 | 4/1976 | Gilbert et al. | 381/10 |
| 4,192,970 | 3/1980 | Kahn | 381/15 |
| 4,377,728 | 3/1983 | Hilbert | 381/15 |
| 4,406,922 | 9/1983 | Parker et al. | 381/15 |
| 4,680,795 | 7/1987 | Eckland | 381/15 |
| 4,866,779 | 9/1989 | Kennedy et al. | 381/15 |
| 5,008,939 | 4/1991 | Bose et al. | 381/15 |

FOREIGN PATENT DOCUMENTS

| | | |
|---|---|---|
| 0410663A2 | 1/1991 | European Pat. Off. . |
| 0420448A2 | 4/1991 | European Pat. Off. . |

OTHER PUBLICATIONS

European Search Report Ref. 90/4426/02, Application No. 92303247.8, dated Mar. 26, 1993.

*Primary Examiner*—Jin F. Ng
*Assistant Examiner*—Edward Lefkovitz
*Attorney, Agent, or Firm*—Fish & Richardson

[57] ABSTRACT

A receiver for receiving a stereophonic signal with upper and lower sidebands carrying a modulating signal includes independent sideband circuitry for providing upper and lower sideband signals. Selector circuitry responds to the level of audible noise in each of the upper and lower sideband signals for selecting that one of the sideband signals having a lower level of audible noise relative to the other. An ISB highpass filter filters the latter sideband signal to provide a highpass filtered sideband signal. Stereo detector circuitry provides left and right stereophonic audio signals. At least one audio lowpass filter filters the left and right stereophonic signals to provide corresponding lowpass filtered left and right stereophonic audio signals. At least one signal combiner combines the highpass filtered sideband signal with each of the lowpass filtered left and right stereophonic audio signals to provide corresponding composite left and right audio signals.

37 Claims, 21 Drawing Sheets

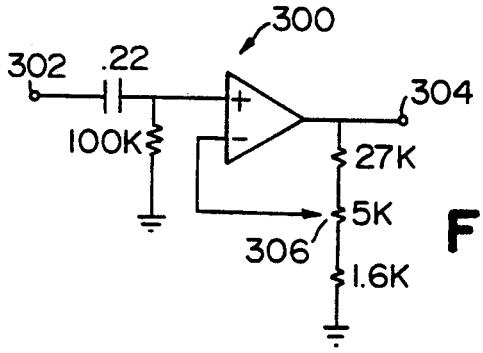
FIG. 9A
FIG. 9B
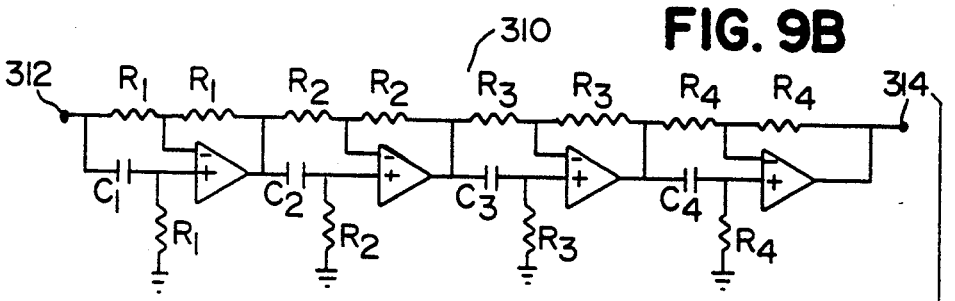
| | $R_1$ | $C_1$ | $R_2$ | $C_2$ | $R_3$ | $C_3$ | $R_4$ | $C_4$ |
|---|---|---|---|---|---|---|---|---|
| I(86), L(94), R(96) | 39.1K | .33 | 10K | .1 | 10K | .01 | 243K | .0047 |
| Q(88) | 15K | .22 | 6.81K | .047 | 6.81K | .0047 | 681 | .0047 |
TABLE 1
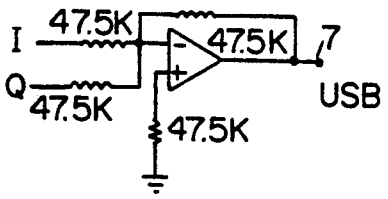
FIG. 9C
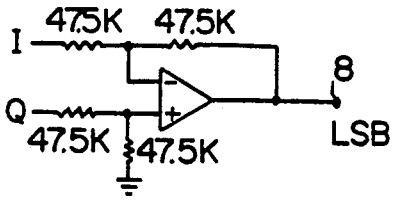
FIG. 9D

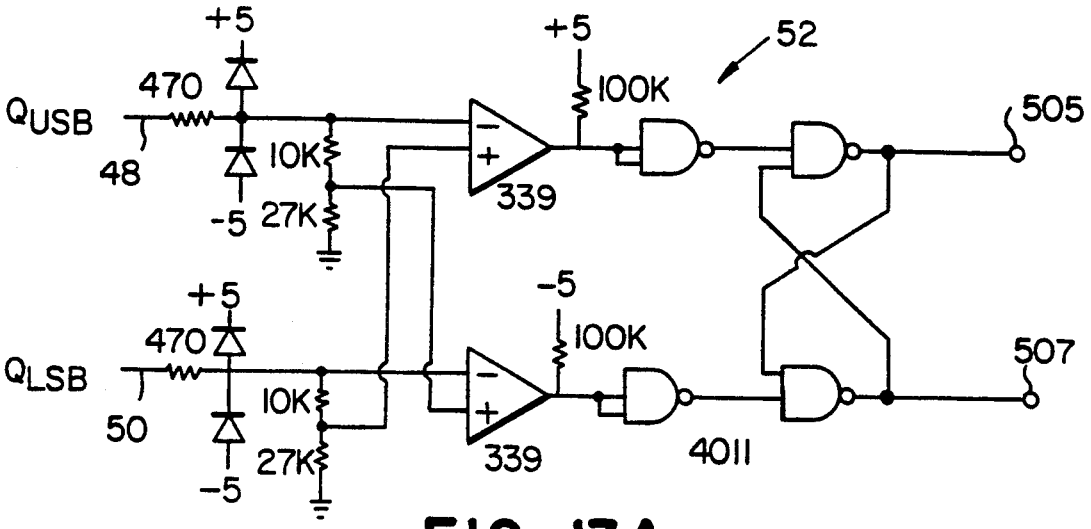
FIG. 13A
FIG. 13B
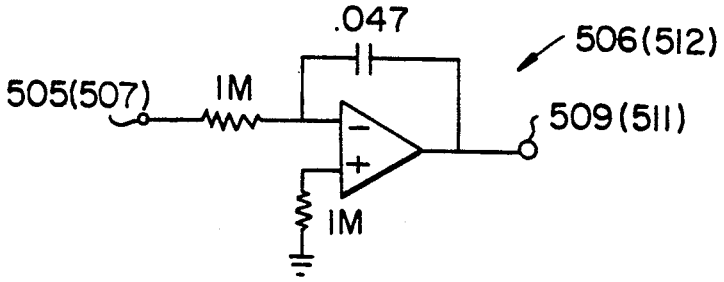
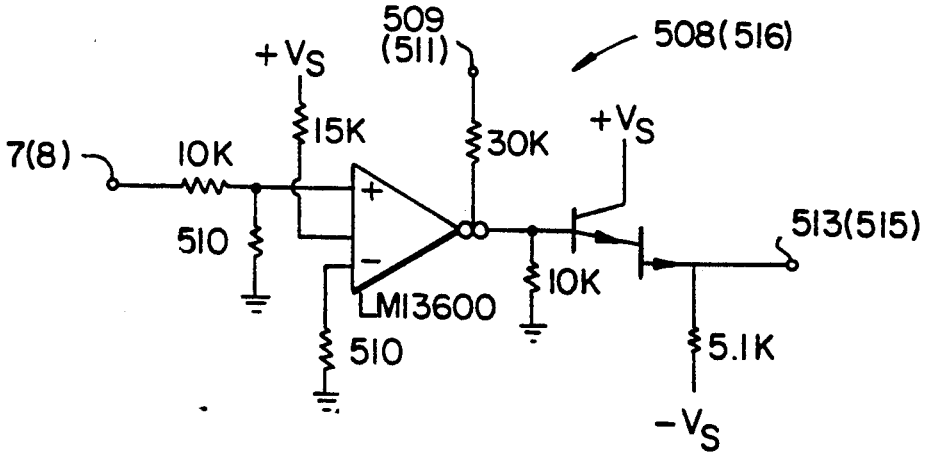
FIG. 13C

FIG. 13D
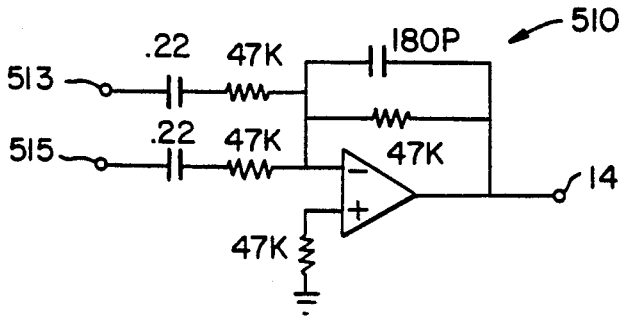
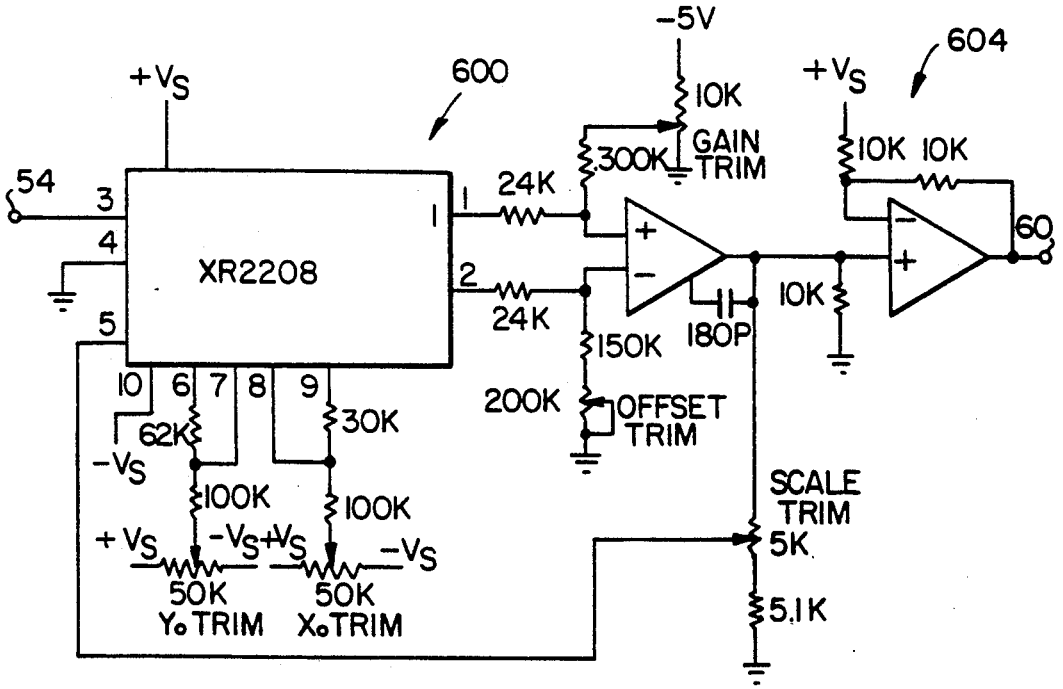
FIG. 14

FIG. 16A
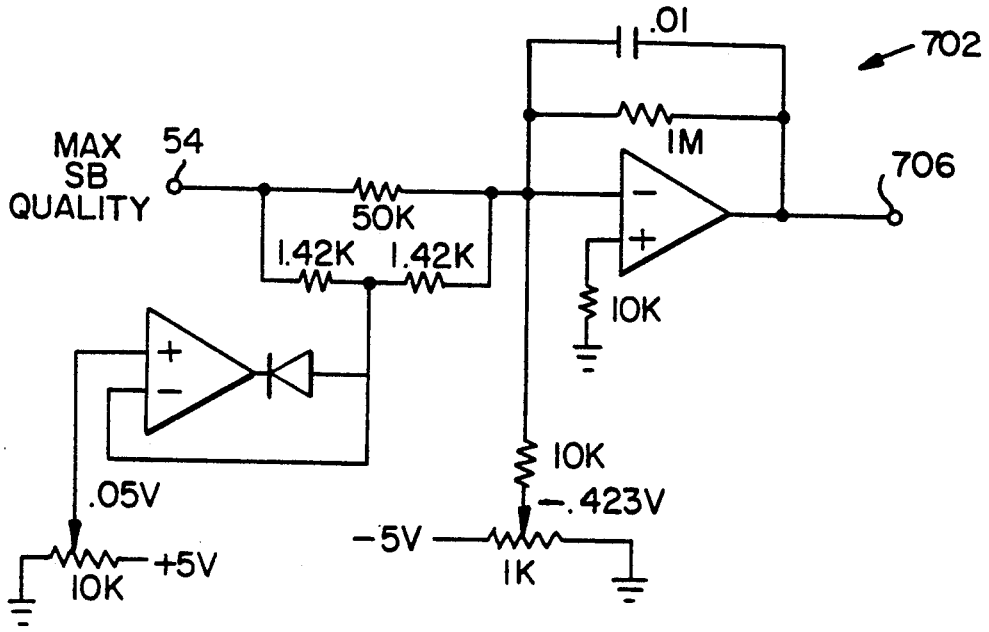
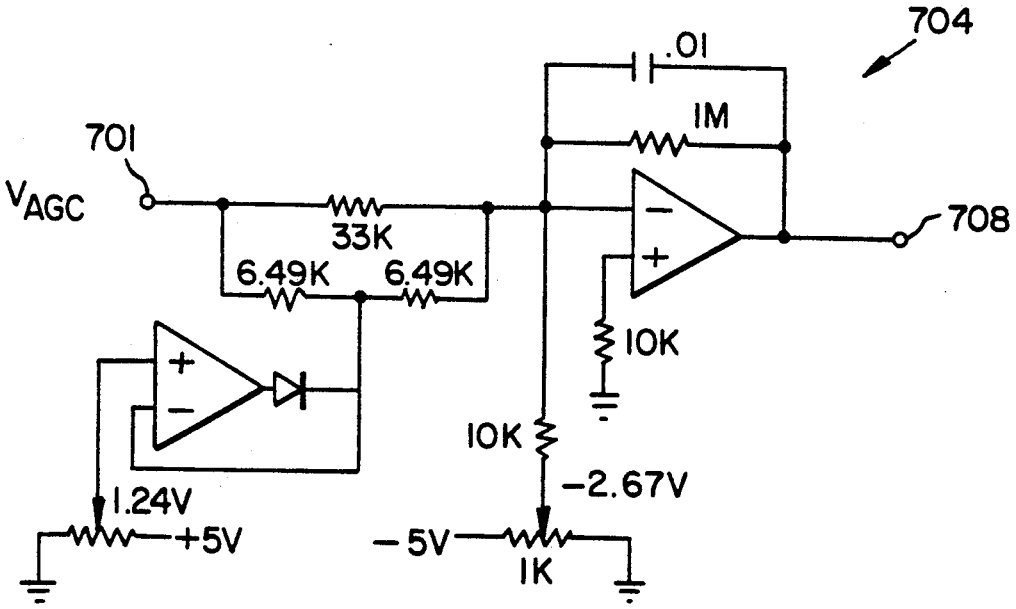
FIG. 16B

REDUCING AUDIBLE NOISE IN STEREO RECEIVING

This invention relates to reception of low frequency information amplitude modulating a high frequency carrier.

Amplitude modulation (AM) broadcast channel assignments set the frequency spacing between carrier frequencies of adjacent channels typically at 10 kHz, allowing the modulating signal in each channel to have spectral components within 10 kHz. The bandwidth for an AM double sideband signal is twice the highest spectral component of the modulating signal. For example, if an AM carrier frequency is $F_c$ and the highest modulating frequency is $F_m$, the bandwidth of the AM signal embraces lower and upper sidebands in the frequency range of $F_c-F_m$ to $F_c+F_m$. To reduce interference of wide bandwidth transmissions, assigned AM channels in a local area are widely spaced. However, when transmission conditions are favorable, such as at night, distant AM signals often interfere with local signals. Interference of this type usually results in a 10 kHz beat note, or whistle, corresponding to the beat frequency with the carrier of the interfering station, and "monkey chatter." To reduce audibility of this interference, AM receivers typically include a filter for cutting off audio frequencies above 3 kHz from the i-f frequency in the IF amplifier or after the demodulation stage. This filter prevents reproduction of higher frequency spectral components, which are desired for high fidelity. Therefore, the typical receiver does not reproduce the higher frequency spectral components necessary for high fidelity reproduction. "Monkey chatter" is the audible result of reproducing the audio signal of the adjacent channel with its spectrum inverted around 10 kHz. Since most of the energy in speech and music tends to be at low and mid frequencies, most of the energy in the resulting monkey chatter tends to be at high frequencies. Monkey chatter is especially annoying because there is rarely sufficient high frequency energy in the demodulated audio signal of the desired station to acoustically mask the undesired monkey chatter. The filter with 3 kHz cutoff does reject the most annoying portion of the monkey chatter, but at the expense of losing fidelity of the desired audio signal.

The modulated signal can be recovered from either sideband. Single sideband (SSB) receivers allow independent selection of either sideband to reduce noise. Other AM receivers demodulate the sidebands separately and add the resulting demodulated signals. Still other AM receivers have 10 kHz bandpass filters on each sideband to detect the carrier of interfering stations, and provide variable band-reject filters for reducing the high frequency noise in sidebands adjacent to an interfering channel.

Some stereophonic AM systems transmit signals with different spectral distributions in the two sidebands. Kahn (U.S. Pat. Nos. 3,218,393, 4,018,994, and 4,641,341) and Ecklund (U.S. Pat. No. 4,489,431) disclose different AM stereo systems. The former system transmits left and right stereo information separately in the two sidebands. The latter system (the CQUAM stereo system) amplitude and phase modulates the carrier with the sum, and difference, respectively, of the stereo signals.

Some methods for reducing the effect of adjacent channel interference rely on receiving and treating the two sidebands independently. Kahn (U.S. Pat. Nos. 4,192,970 and 4,206,317) discloses receiving the sidebands independently (as would be necessary in a stereo receiver using his process), measuring the amount of interference in each sideband, and altering the frequency response of each sideband commensurate with the level of interference found therein. Bose et al., U.S. Pat. No. 5,008,939 assigned to the assignee of this application, the disclosure of which is incorporated herein by reference, discloses independently receiving the sidebands with an independent sideband (ISB) receiver, demodulating each sideband, measuring the interference level on each sideband, and selecting the sideband having the lower level of interference for audio reproduction.

According to the invention, there is a receiver for receiving a stereophonic signal with upper and lower sidebands carrying a modulating signal including independent sideband circuitry for providing upper and lower sideband signals. Selector circuitry responds to the level of audible noise in each of the upper and lower sideband signals for selecting that one of the sideband signals having a lower level of audible noise relative to the other. An independent sideband (ISB) highpass filter filters the latter sideband signal to provide a highpass filtered sideband signal. Stereo detector circuitry provides left and right stereophonic audio signals. At least one audio lowpass filter filters the left and right stereophonic signals to provide corresponding lowpass filtered left and right stereophonic audio signals. At least one signal combiner combines the highpass filtered sideband signal with each of the lowpass filtered left and right stereophonic audio signals to provide corresponding composite left and right audio signals.

The selector circuitry may comprise prefilter circuits responsive to the upper and lower sideband signals for providing corresponding upper and lower sideband quality signals representing the level of audible noise present in the upper and lower sideband signals respectively. A signal comparator responsive to the level of the upper and lower sideband quality signals may provide a logic control signal having one of at least two states representative of that one of the sideband quality signals having a signal level greater than the other. A switch may provide one of the upper and lower sideband signals in response to the state of the logic control signal. The prefilters may comprise high-Q bandpass filters centered at a frequency corresponding to the separation between carrier frequencies of adjacent channels, such as 10 kHz in the United States AM broadcast band. The switch may comprise a crossfade circuit. The crossfade circuit may include at least one variable gain amplifier for amplifying each of the upper and lower sideband signals, the variable gain amplifiers each having a gain responsive to control signals related to the upper and lower sideband quality signals, and a summer for combining the outputs of the variable gain amplifiers. The crossfade circuit may further comprise a logic device responsive to the sideband quality signals for providing the control signals, and at least one integrator for integrating the control signals for controlling the variable gain amplifiers.

According to an aspect of the invention the low frequency cutoff of the ISB highpass filter and the high frequency cutoff of the at least one audio lowpass filter are at substantially the same frequency that is a crossover frequency. The ISB highpass filter may further comprise a variable highpass filter having a low frequency cutoff responsive to a first control signal. The audio lowpass filter may further comprise a variable lowpass filter having a high frequency cutoff responsive to the first control signal. The receiver may include a first interference detector for detecting audible noise in each of the left and right stereophonic audio signals output from the stereo detector and provide the first control signal responsive to the audible noise detected such that the high frequency cutoff of the at least one audio lowpass filter reduces the audible noise in each filtered left and right stereophonic audio signals output from the audio lowpass filter. The ISB highpass filter and the audio lowpass filter may comprise a complementary pair of variable second-order filters. The audio lowpass filter may comprise a first variable second-order lowpass filter with real poles. The ISB highpass filter may comprise an allpass filter in parallel with a second variable second-order lowpass filter with real poles having the same filter characteristic as the first variable second-order lowpass filter with real poles, and a differential signal combiner for subtracting the second variable second-order lowpass filter with real poles from the variable allpass filter.

There may be a signal converter for converting that one of the selected left and right audio quality signals into the first control signal. The signal converter may comprise a nonlinear circuit.

Other features and advantages will become apparent from the following detailed description when read in connection with the accompanying drawings in which.

Figure 1:
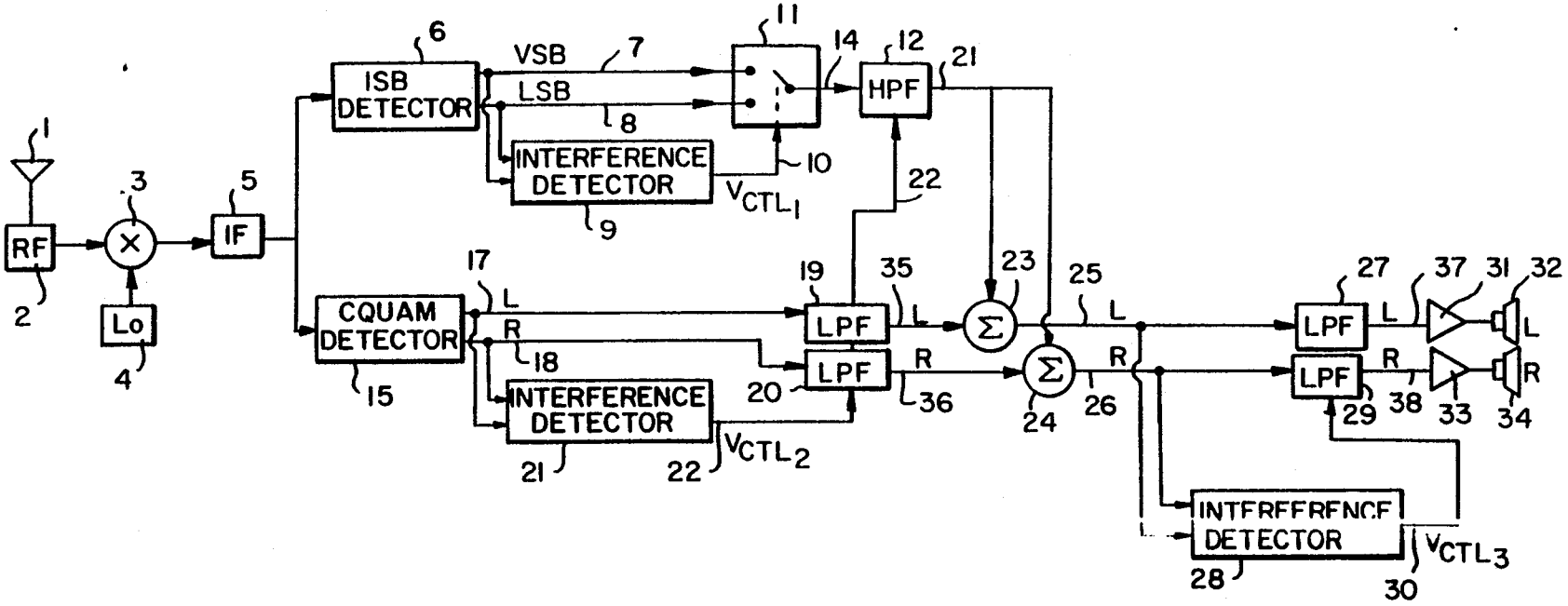
FIG. 1 is a block diagram of a stereophonic AM receiving system according to the invention.
Figure 5:
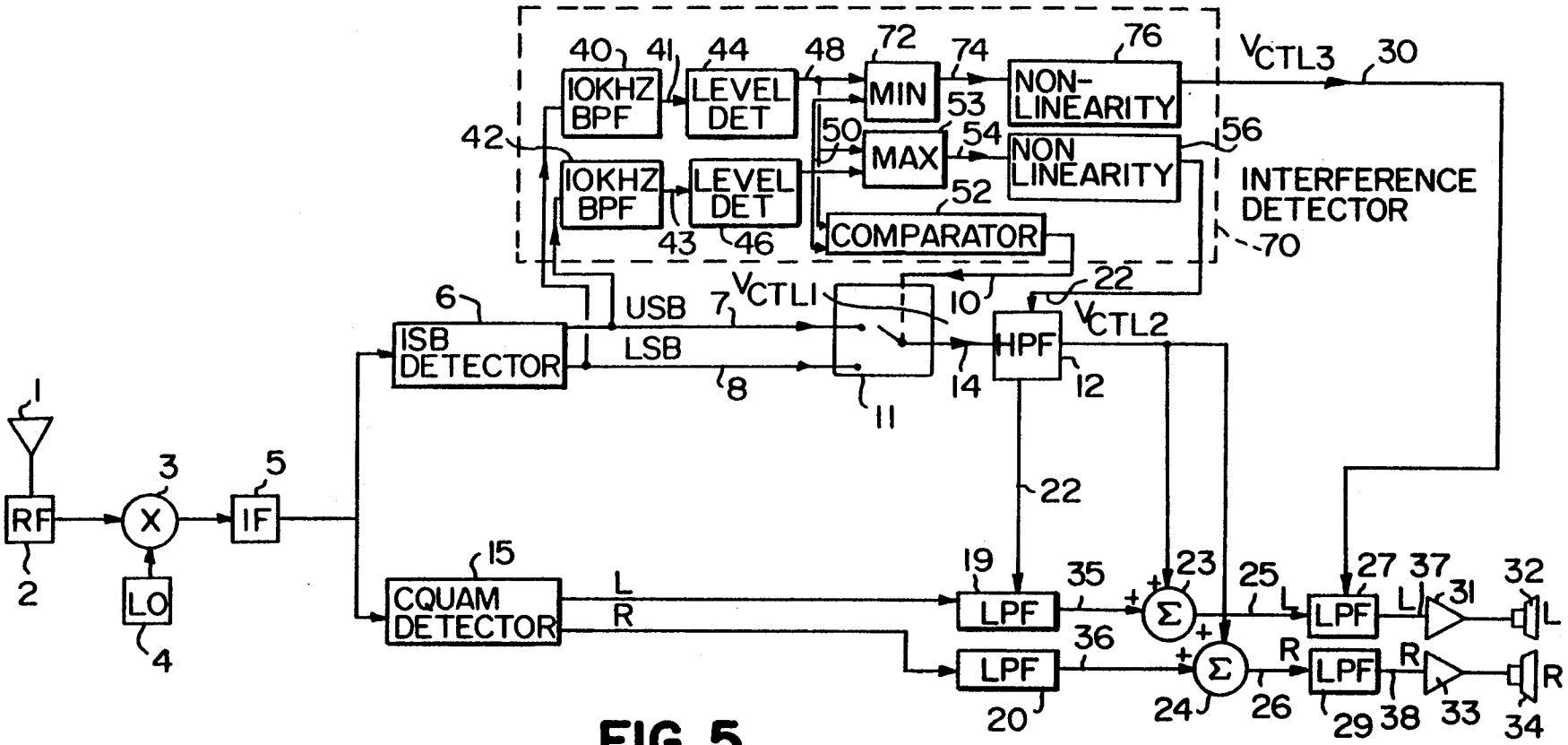
FIG. 5 is a block diagram of an alternative embodiment of an AM stereophonic receiving system according to the invention.
Figure 7:
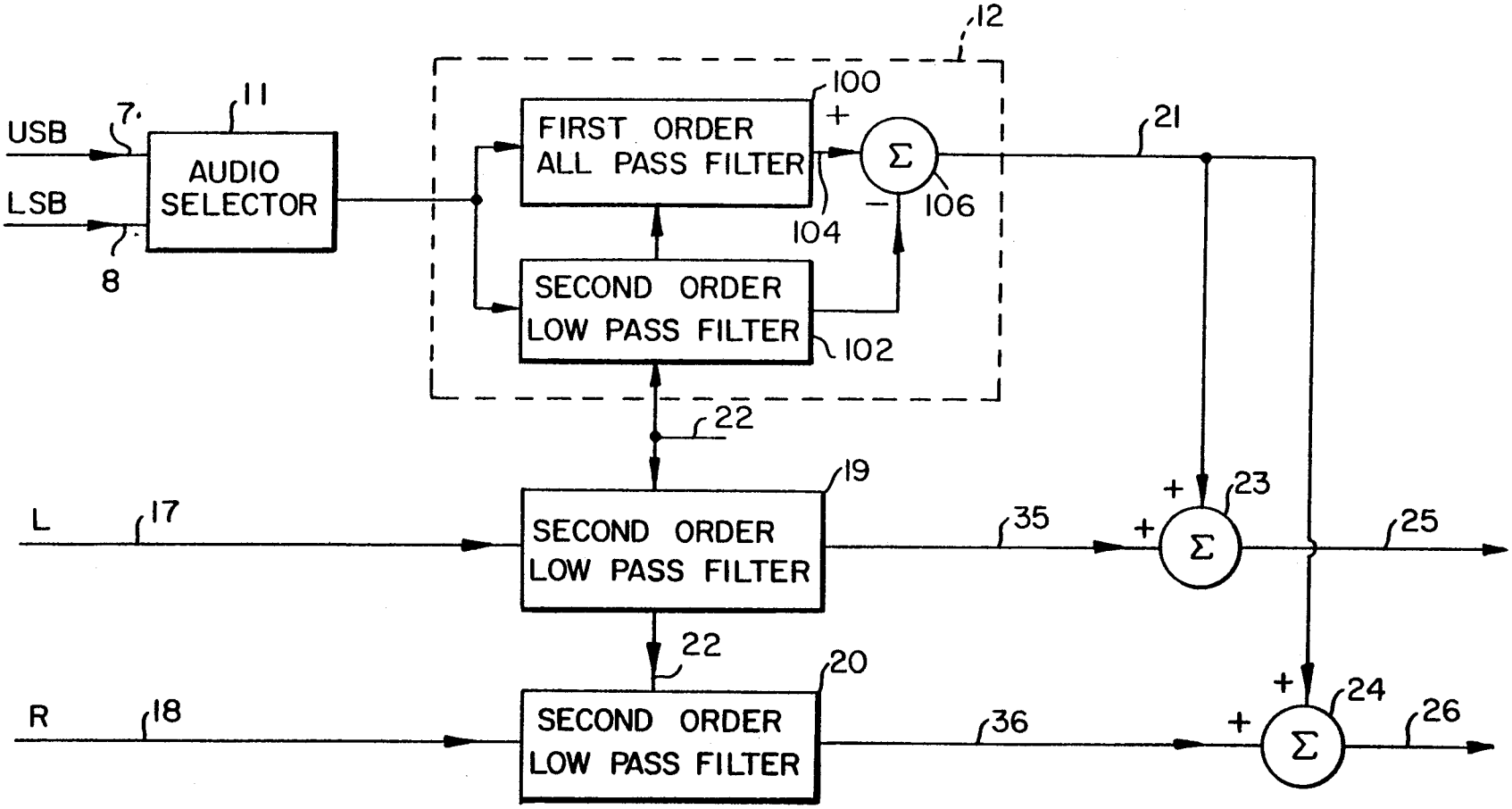
Figure 8:
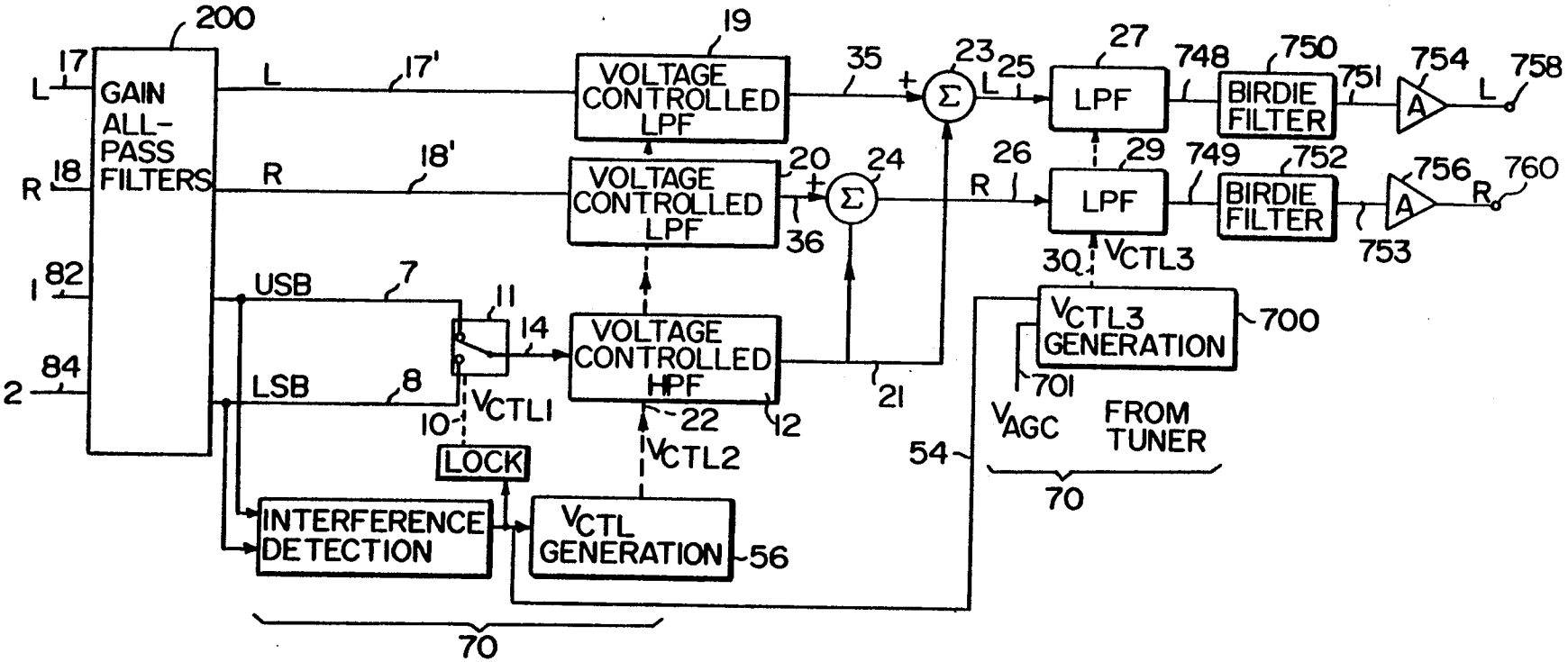
Figure 10:
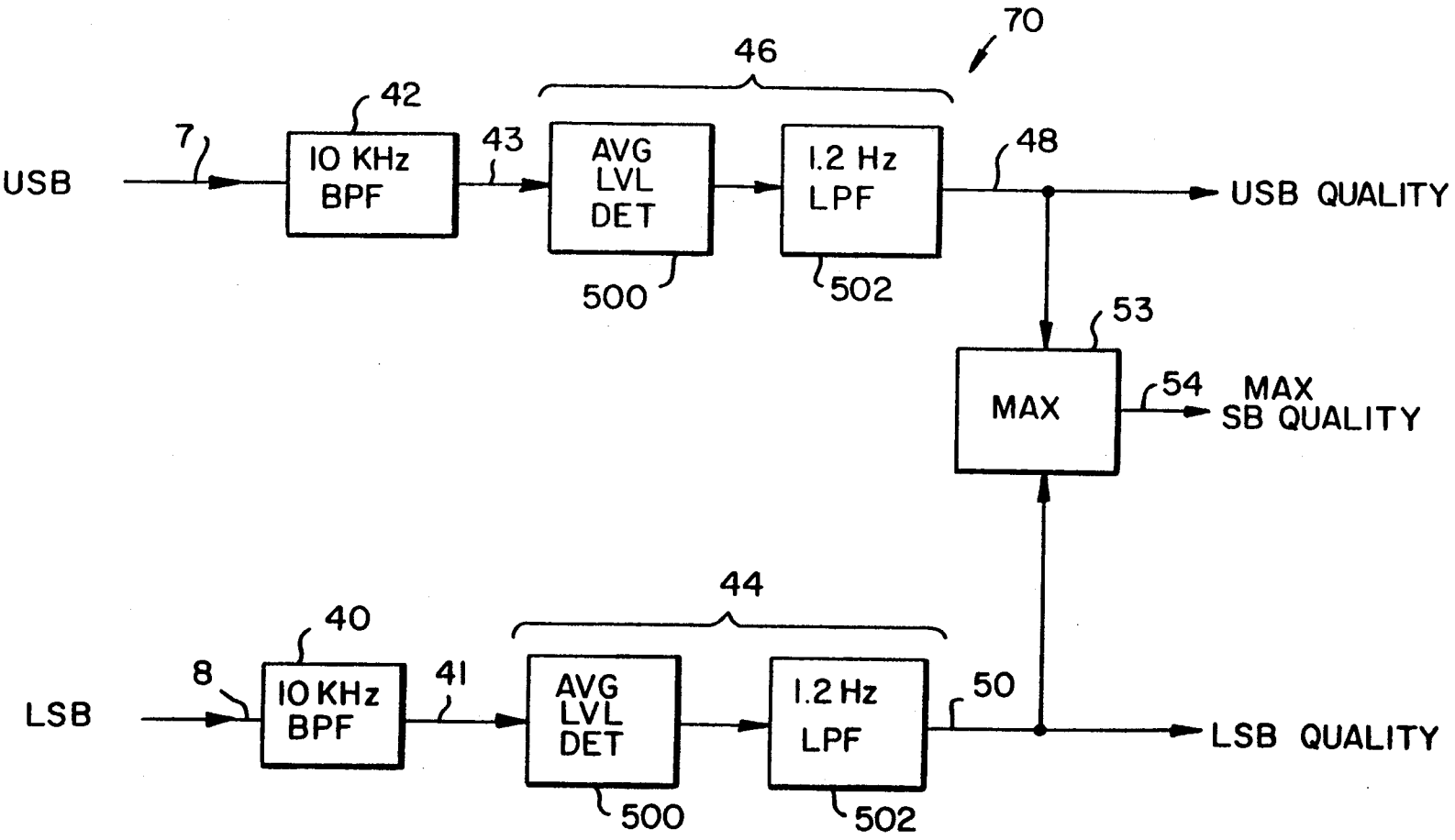
Figure 11A:
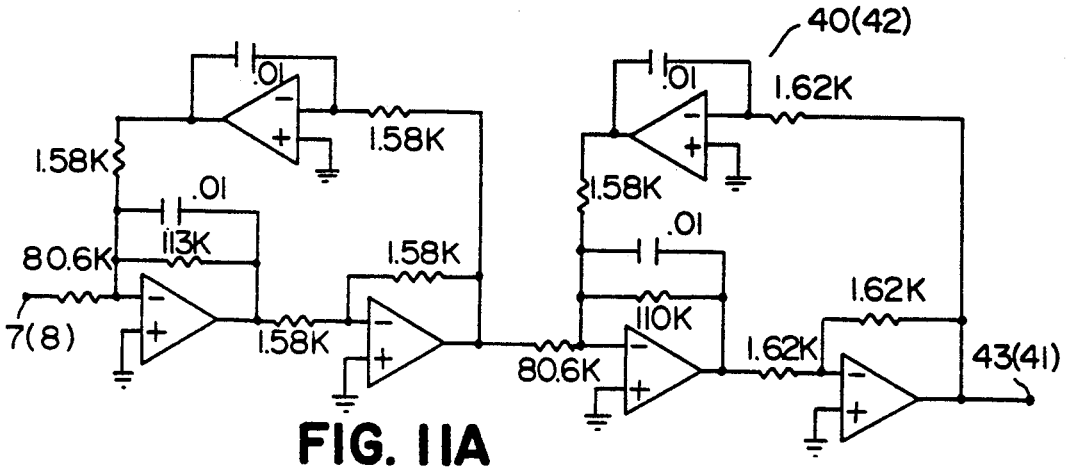
Figure 11B:
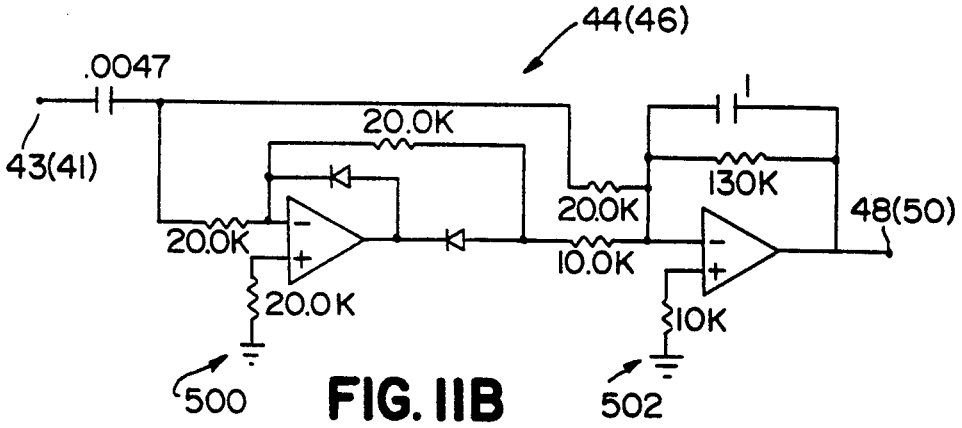
Figure 11C:
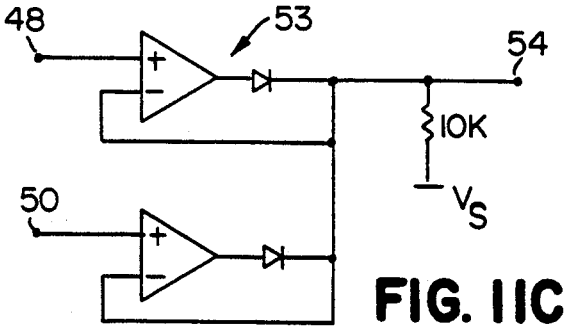
Figure 12:
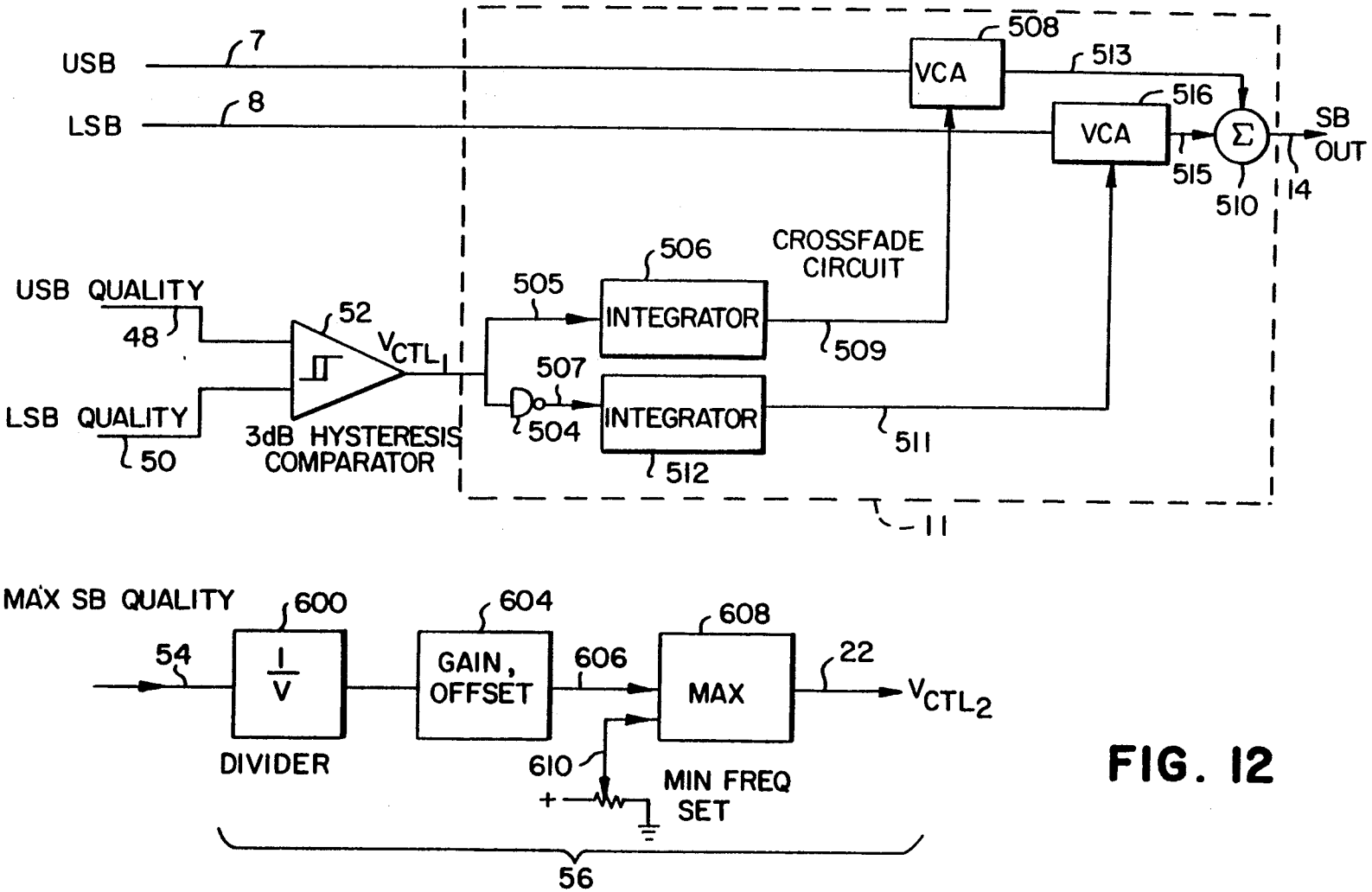
Figure 15:
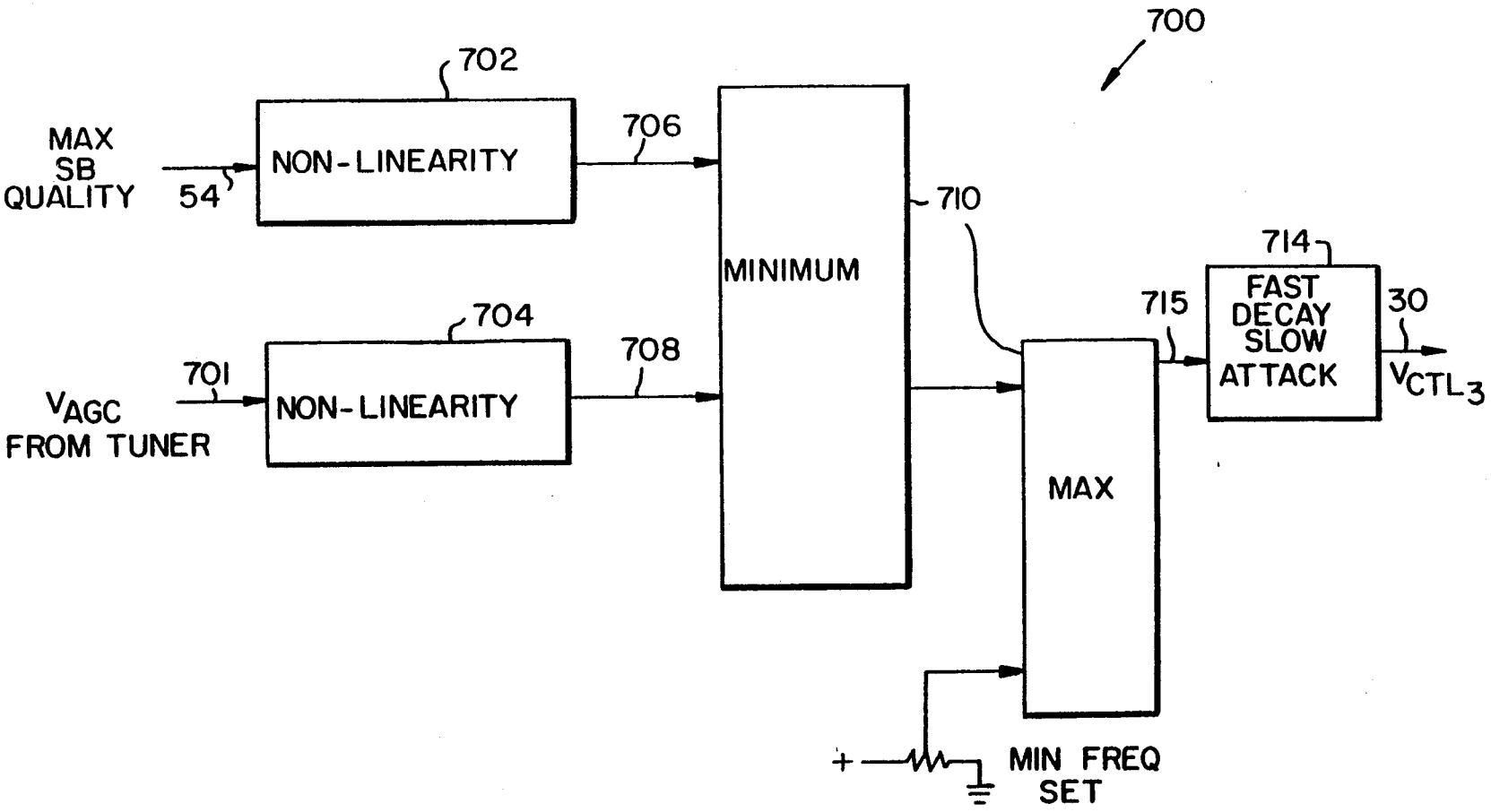
Figure 16C:
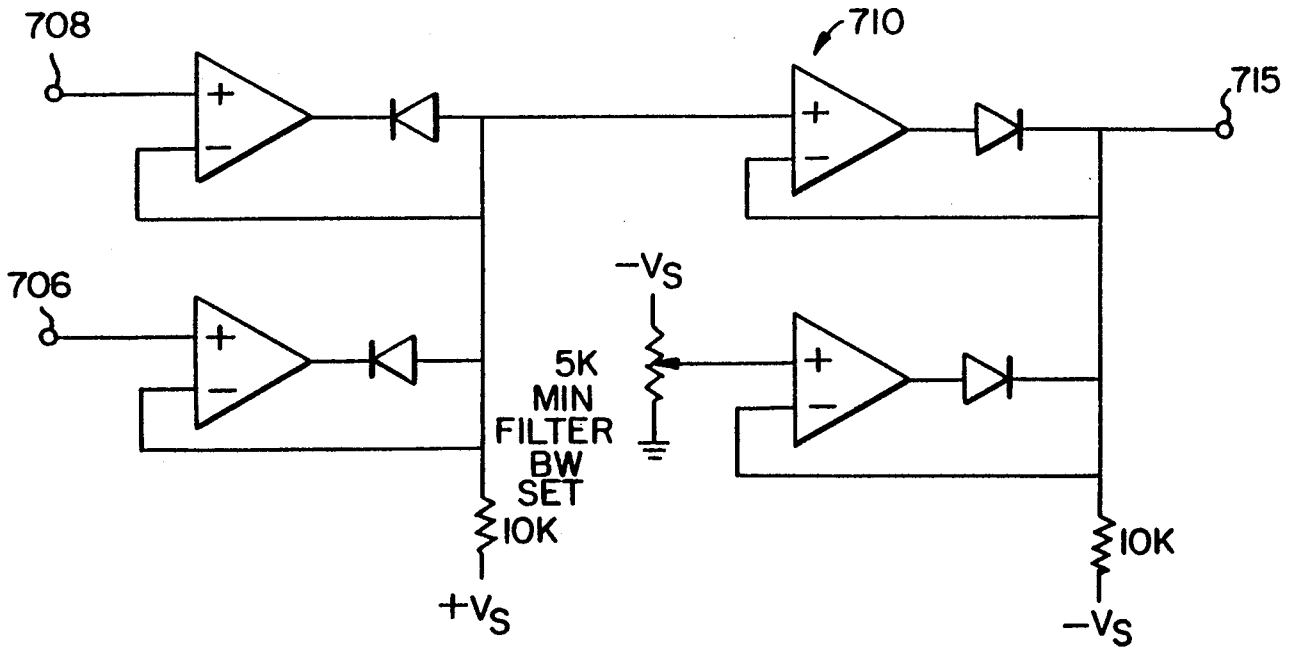
Figure 17A:
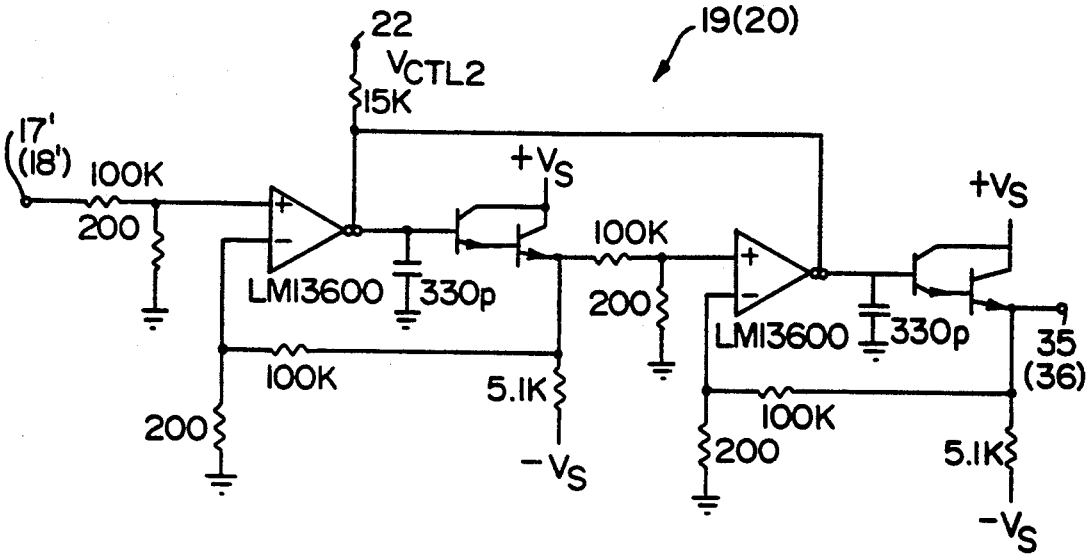
Figure 17B:
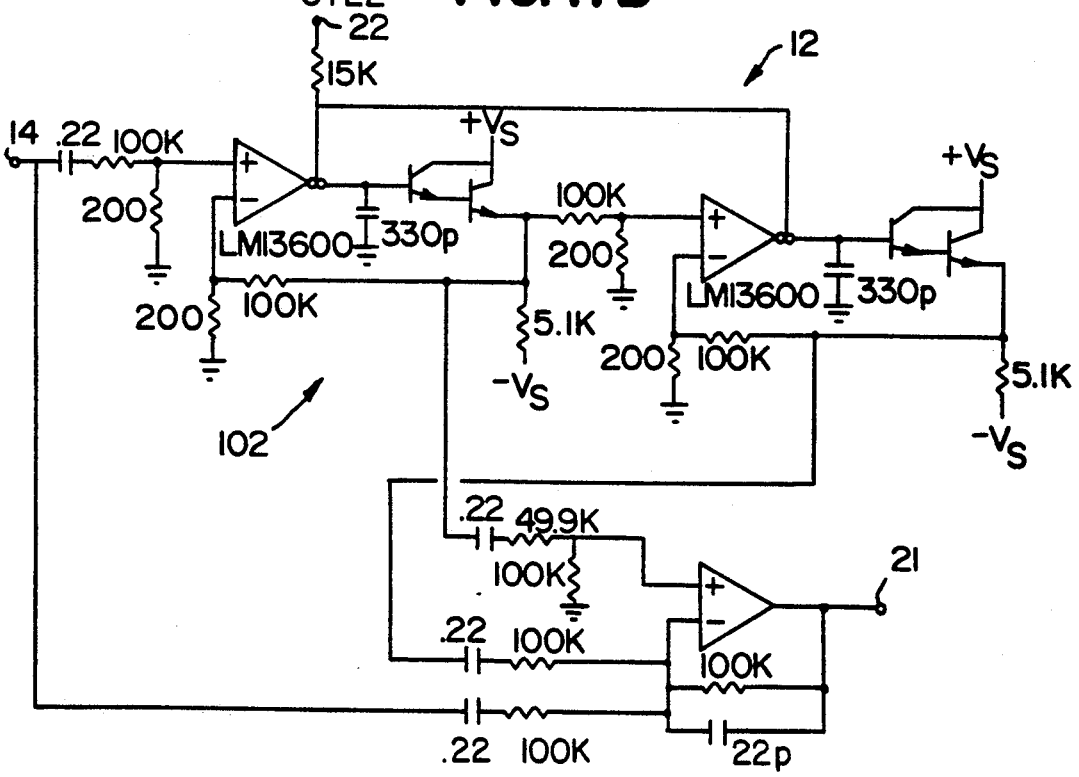
Figure 17C:
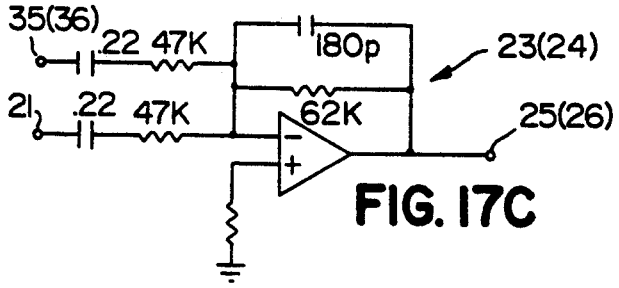
Figure 19A:
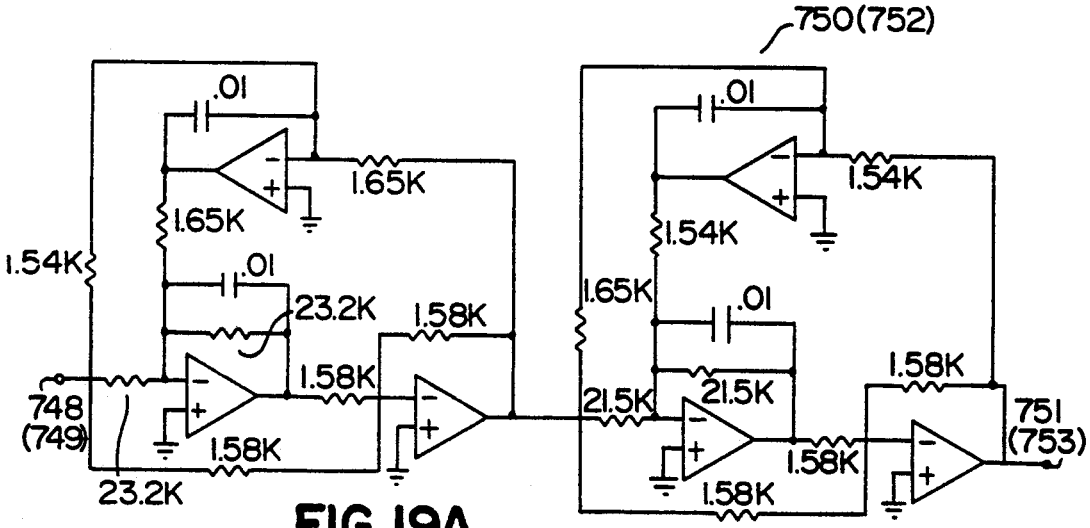
Figure 19B:
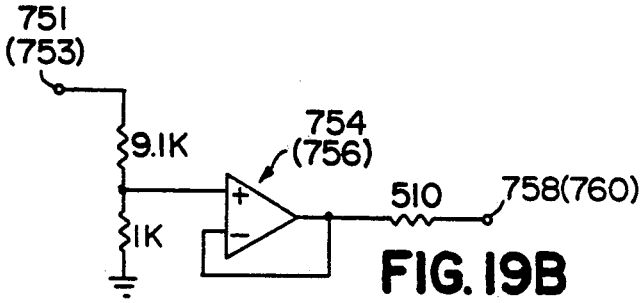
Figure 18:
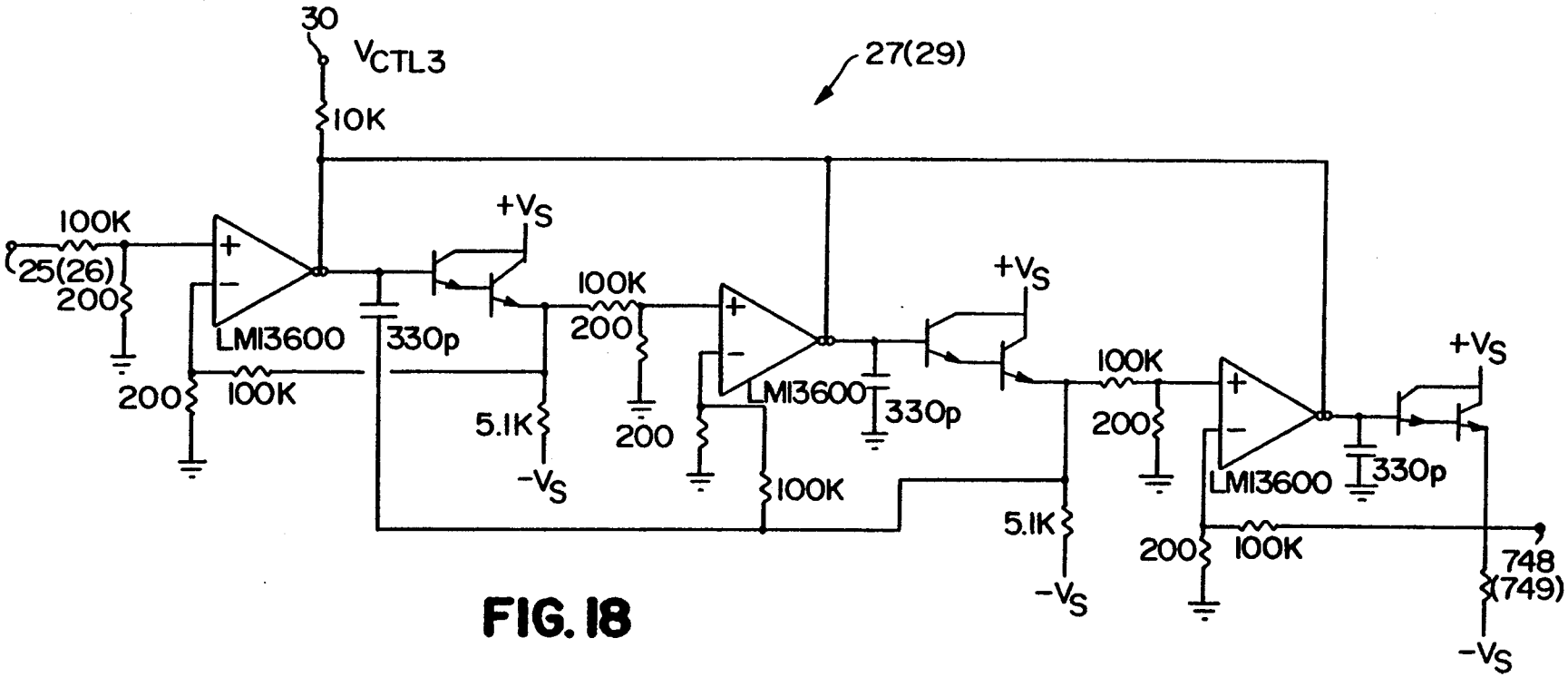
Figure 20:
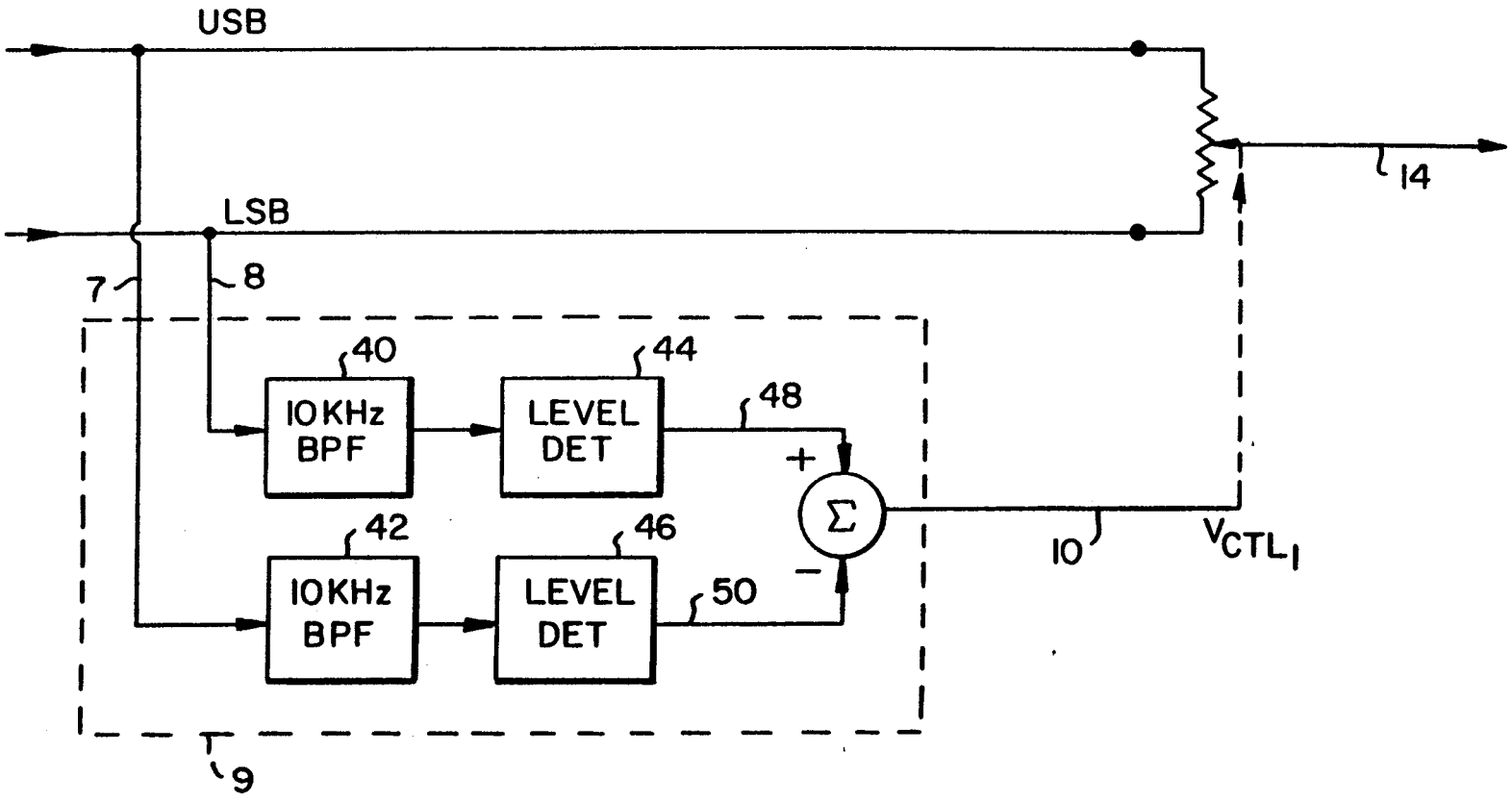

FIG. 7 is a block diagram of an exemplary embodiment of voltage-controlled highpass filter 12 and voltage-controlled lowpass filters 19 and 20 of the receiver system of FIG. 1;

FIG. 8 is a block diagram of another exemplary embodiment of the invention;

FIGS. 9(A)-9(D) show electronic circuit schematic diagrams of an embodiment of allpass filter bank 200;

FIGS. 10 and 12 show detailed block diagrams of an exemplary embodiment of interference detector 70 of FIGS. 5 and 8;

FIG. 11(A) shows an electronic circuit schematic diagram of an embodiment of a fourth-order Butterworth bandpass filter having a Q=50 and center frequency 100 kHz for bandpass filters 40 and 42 of interference detector 70;

FIG. 11(B) is a schematic circuit diagram of a 1.2 Hertz lowpass filter;

FIG. 11(C) is a schematic circuit diagram of an embodiment of Max quality detector 53;

FIGS. 13(A)-13(D) show schematic circuit diagrams of an embodiment of comparator 52 and crossfade sideband selector 11 of FIG. 12;

FIG. 14 is a schematic circuit diagram of an embodiment of divider circuit 600 and gain and offset circuit 604;

FIG. 15 is a block diagram of an embodiment of $V_{CTL3}$ generator 700 of interference detector 70 of the embodiment of FIG. 8;

FIG. 16(A) is a schematic circuit diagram of an embodiment of nonlinear circuit 702;

FIG. 16(B) is a schematic circuit diagram of nonlinear circuit 704;

FIG. 16(C) is a schematic circuit diagram of Min/-Max selector 710;

FIG. 17(A) is a schematic circuit diagram of an embodiment of voltage-controlled lowpass filters 19 and 20;

FIG. 17(B) is a schematic circuit diagram of an embodiment of voltage-controlled highpass filter 12 of FIG. 8;

FIG. 17(C) is a schematic circuit diagram of an embodiment of summers 23 and 24 of FIG. 8;

FIG. 18 is a schematic circuit diagram of an embodiment of voltage-controlled lowpass filters 27 and 29 of FIG. 8;

FIG. 19(A) is a schematic circuit diagram of an embodiment of birdy filters 750 and 752 in the audio output stage of the embodiment of FIG. 8;

FIG. 19(B) is a schematic circuit diagram of an embodiment of audio output amplifiers 754 and 756 of FIG. 8; and FIG. 20 is a block diagram illustrating the logical arrangement of a crossfade ISB sideband selector.

Referring to FIG. 1, there is shown a block diagram of an embodiment of a stereophonic AM receiving system in accordance with the invention. This receiving system comprises an antenna 1 connected to a radio frequency amplifier 2. The output of radio frequency amplifier 2 is connected to a mixer 3. The other input of mixer 3 is connected to a local oscillator 4. The output of mixer 3 is connected to an intermediate frequency amplifier 5. The intermediate frequency amplifier 5 is connected to an independent sideband detector 6. The outputs of independent sideband detector 6 are the upper and lower sideband audio signals on lines 7 and 8, respectively. Upper sideband audio signal on line 7 is connected to one input of an audio selector 11 and to one input of an interference detector 9. Lower sideband audio signal on line 8 is connected to another input of audio selector 11 and to another input of interference detector 9. Interference detector 9 outputs a logic control signal $V_{CTL1}$ on line 10 which controls audio selector 11. Audio selector 11 selects between either the upper sideband audio signal available on line 7 or the lower sideband audio signal available on line 8, dependent on the condition of logic control signal $V_{CTL1}$. The output of audio selector 11 is connected to the input of a voltage-controlled highpass filter 12.

The output of intermediate frequency amplifier 5 is also connected to a CQUAM stereo detector 15 which provides a left stereo audio signal on line 17 and a right stereo audio signal on line 18. Left audio signal on line 17 is connected to the input of a voltage-controlled lowpass filter 19 and to one input of an interference detector 21. Right audio signal on line 18 is connected to the input of voltage-controlled lowpass filter 20 and to another input of interference detector 21. Interference detector 21 provides a voltage control signal $V_{CTL2}$ on line 22 which controls the passband Characteristics of voltage-controlled highpass filter 12, voltage-controlled lowpass filter 19 and voltage-controlled lowpass filter 20.

The output of voltage-controlled highpass filter 12, comprising energy from either the upper or lower sideband audio signal selected by audio selector 11, is connected to an input of a summer 23 and an input of a summer 25. The filtered left audio signal output from voltage-controlled lowpass filter 19 is connected to another input of summer 23. The right audio signal output from voltage-controlled lowpass filter 20 is connected to another input of summer 24. Summer 23 provides a composite left audio signal on line 25 which is the sum of the highpass filtered upper or lower sideband audio, and the lowpass filtered left stereo audio signal. Similarly, summer 24 provides a composite right audio signal on line 26 which is the sum of the highpass filtered upper or lower sideband audio, and the lowpass filtered right stereo audio signal.

The left composite audio signal on line 25 is connected to the input of a voltage-controlled lowpass filter 27 and to an input of an interference detector 28. The right composite audio signal on line 26 is connected to the input of a voltage-controlled lowpass filter 29 and to another input of interference detector 28. Interference detector 28 provides a voltage control signal $V_{CTL3}$ on line 30 which controls the passband characteristics of voltage-controlled lowpass filter 27 and voltage-controlled lowpass filter 29. The left composite audio signal output from lowpass filter 27 is connected to an audio amplifier 31 which drives a left channel loudspeaker 32. The right composite audio signal output from lowpass filter 29 is connected to an audio amplifier 33 which drives a right channel loudspeaker 34.

Figure 2:
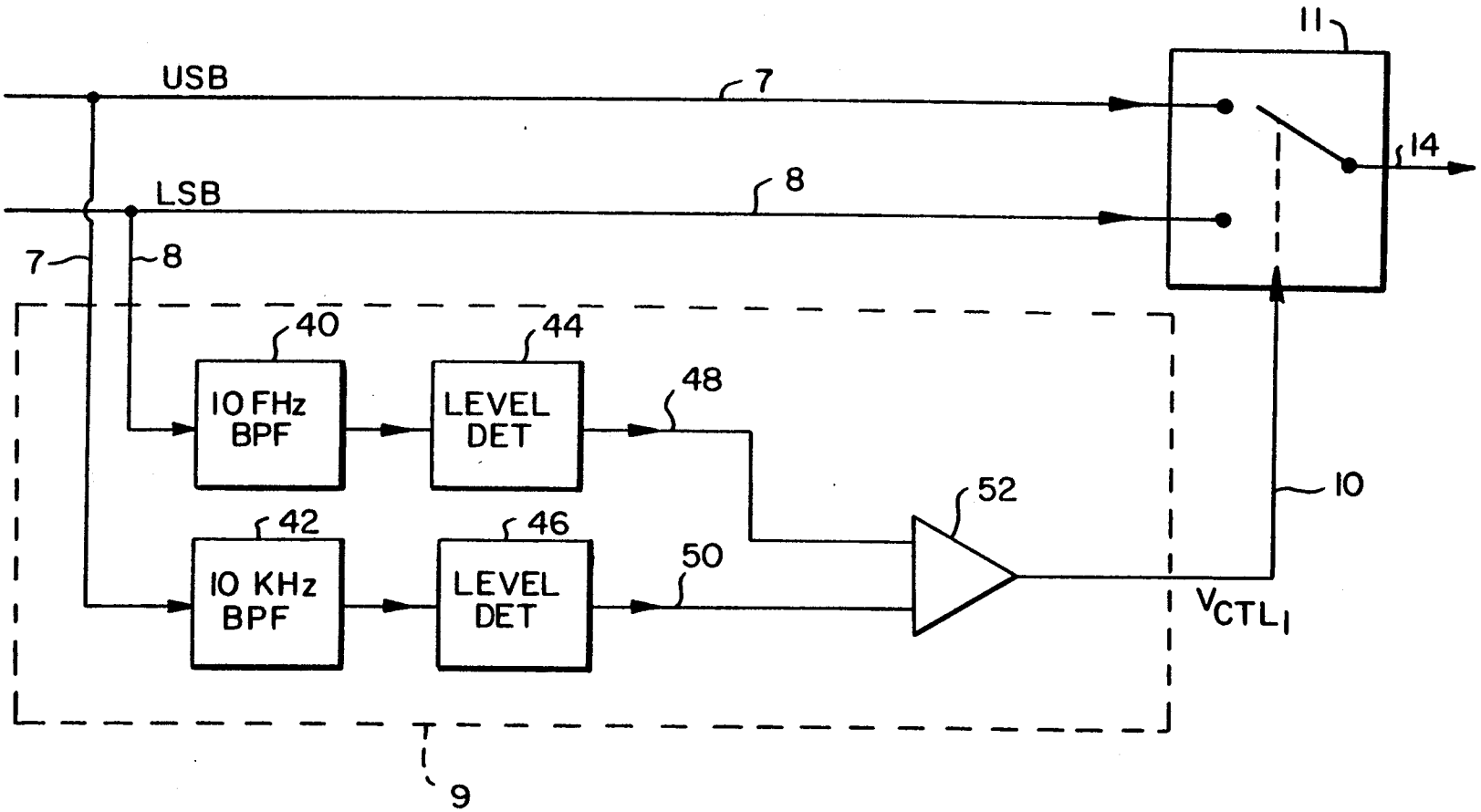
FIG. 2 is a block diagram of an embodiment of an exemplary interference detector 9 of FIG. 1.

Referring to FIG. 2, there is shown a block diagram of an embodiment of interference detector 9 of FIG. 1. The inputs to interference detector 9 are the upper sideband audio signal on line 7 and the lower sideband audio signal on line 8, both output from ISB detector 6 of FIG. 1. These signals are filtered in parallel by two 10 kHz high-Q bandpass filters 40 and 42. The outputs of bandpass filters 40 and 42 are connected to level detectors 44 and 46, respectively. Level detector 44 produces a lower sideband quality signal on line 48 representing the level of 10 kHz energy present in the lower sideband audio signal. Similarly, level detector 46 produces an upper sideband quality signal on line 50 representing the level of 10 kHz energy present in the upper sideband audio signal. The lower sideband quality signal on line 48 and the upper sideband quality signal on line 50 are each connected to an input of a comparator 52. Comparator 52 compares the levels of the upper and lower sideband quality signals and produces the logical voltage control signal $V_{CTL1}$ on line 10 which drives audio selector switch 11.

Figure 3:
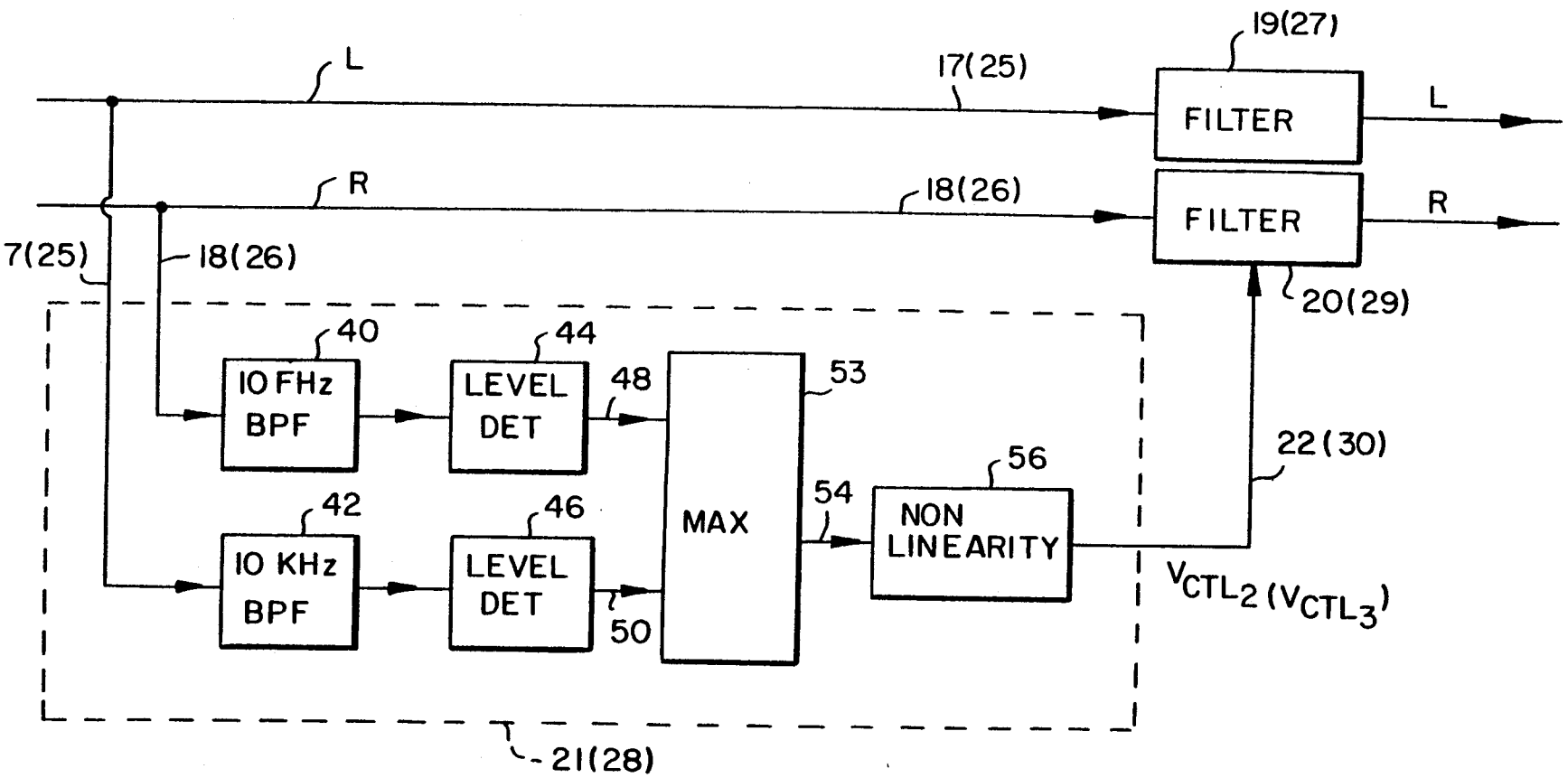
FIG. 3 is a block diagram of an exemplary embodiment of interference detectors 21 or 28 of FIG. 1.

Referring to FIG. 3, there is shown a block diagram of an embodiment of interference detector 21 (or 28) of FIG. 1. The inputs to interference detector 21 (28) are the left audio signal on line 17 (25) and the right audio signal on line 18 (26). Similar to interference detector 9 of FIG. 2, these signals are filtered in parallel by two 10 kHz high-Q bandpass filters 40 and 42. The outputs of the bandpass filters 40 and 42 are connected to level detectors 44 and 46, respectively. Level detector 44 produces a right audio quality signal on line 48 representing the level of 10 kHz energy present in the right audio signal. Similarly, level detector 46 produces a left audio quality signal on line 50 representing the level of 10 kHz energy present in the left audio signal. The right audio quality signal on line 48 and the left audio quality signal on line 50 are each connected to an input of maximum selector 53. Maximum selector 53 compares the levels of the left and right audio quality signals and selects and transfers the larger of these two quality signals to its output on line 54. The selected quality signal on line 54 is connected to the input of a nonlinear circuit 56 which produces voltage control signal $V_{CTL2}$ ($V_{CTL3}$) on line 22 (30) to control the passband characteristics of voltage-controlled lowpass filters 19 (27) and 20 (29), and voltage-controlled highpass filter 12.

Figure 4:
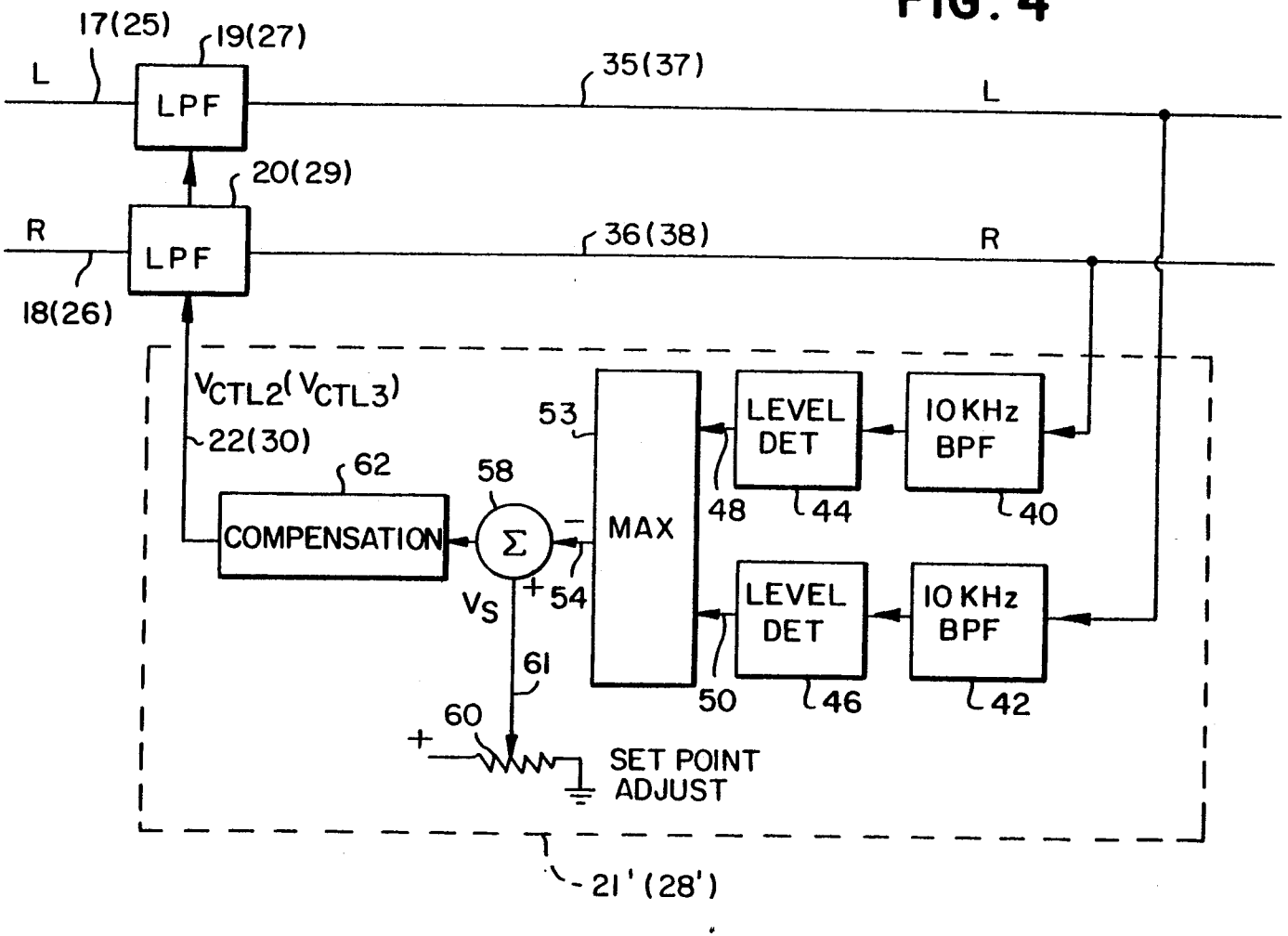
FIG. 4 is a block diagram of an alternative embodiment of interference detector 21 or 28 providing closed-loop control of the passband characteristics of voltage-controlled lowpass filters.

Referring to FIG. 4, there is shown a block diagram of an alternative embodiment of interference detector 21 (28) of FIG. 1 providing closed-loop control of the passband characteristics of voltage-controlled lowpass filters 19 (27) and 20 (29). Here, one input to interference detector 21' (28') is connected to the left audio signal output from lowpass filter 19 (27) on line 35 (37), and the other input is connected to the right audio signal output from lowpass filter 20 (29) on line 36 (38). As with interference detector 2i (28) of FIG. 3, these signals are filtered in parallel by two 10 kHz high-Q bandpass filters 40 and 42, the outputs of which are connected to level detectors 44 and 46, respectively. Again, level detector 44 produces a right audio quality signal on line 48 representing the level of 10 kHz energy present in the right audio signal, and, level detector 46 produces a left audio quality signal on line 50 representing the level of 10 kHz energy present in the left audio signal. Maximum selector 53 compares the levels of the left and right audio quality signals and selects and transfers the larger of these two quality signals to its output on line 54. The selected quality signal on line 54 is connected to an input of a summer 58. A potentiometer 60 generates a set point DC voltage $V_s$ on line 61 which is connected to another input of summer 58. The output of summer 58, which is the selected quality signal on line 54 offset by the DC set point voltage $V_s$, is connected to feedback compensation circuit 62. The output of feedback compensation circuit 62 provides voltage control signal $V_{CTL2}$ ($V_{CTL3}$) on line 22 (30) for controlling the passband characteristics of voltage-controlled lowpass filters 19 (27) and 20 (29), and voltage-controlled highpass filter 12.

Referring to FIG. 5, there is shown a block diagram of an alternative embodiment of an AM stereophonic receiving system in accordance with the invention. Here, interference detectors 9, 21, and 28 of FIG. 1 have been replaced by a single interference detector 70. The inputs to interference detector 70 are the upper sideband audio signal on line 7 and the lower sideband audio signal on line 8, both output from ISB detector 6. Again, these signals are filtered in parallel by two 10 kHz high-Q bandpass filters 40 and 42, the outputs of which are connected to level detectors 44 and 46, respectively, which provide lower sideband quality signal on line 48 and upper sideband quality signal on line 50. The upper and lower sideband quality signals are connected to the inputs of comparator 52 which compares the levels of the quality signals and provides logic control signal $V_{CTL1}$ on output line 10 to control signal selector 11. The upper and lower sideband quality signals are also connected to the inputs of maximum signal selector 53 which selects and transfers the larger of the two quality signals to its output on line 54. The selected quality signal output on line 54 is connected to the input of nonlinear circuit 56 to provide control voltage signal $V_{CTL2}$ on line 22 for controlling the passband characteristics of voltage-controlled highpass filter 12 and voltage-controlled lowpass filters 19 and 20. The upper and lower sideband quality signals are further connected to the inputs of a minimum signal selector 72. Minimum signal selector 72 compares the levels of the upper and lower sideband quality signals and selects and transfers the smaller of these two quality signals to its output on line 74. The selected quality signal on line 74 is connected to the input of a nonlinear circuit 76 which produces voltage control signal $V_{CTL3}$ on line 30 to control the passband characteristics of voltage-controlled lowpass filters 27 and 29.

Figure 6:
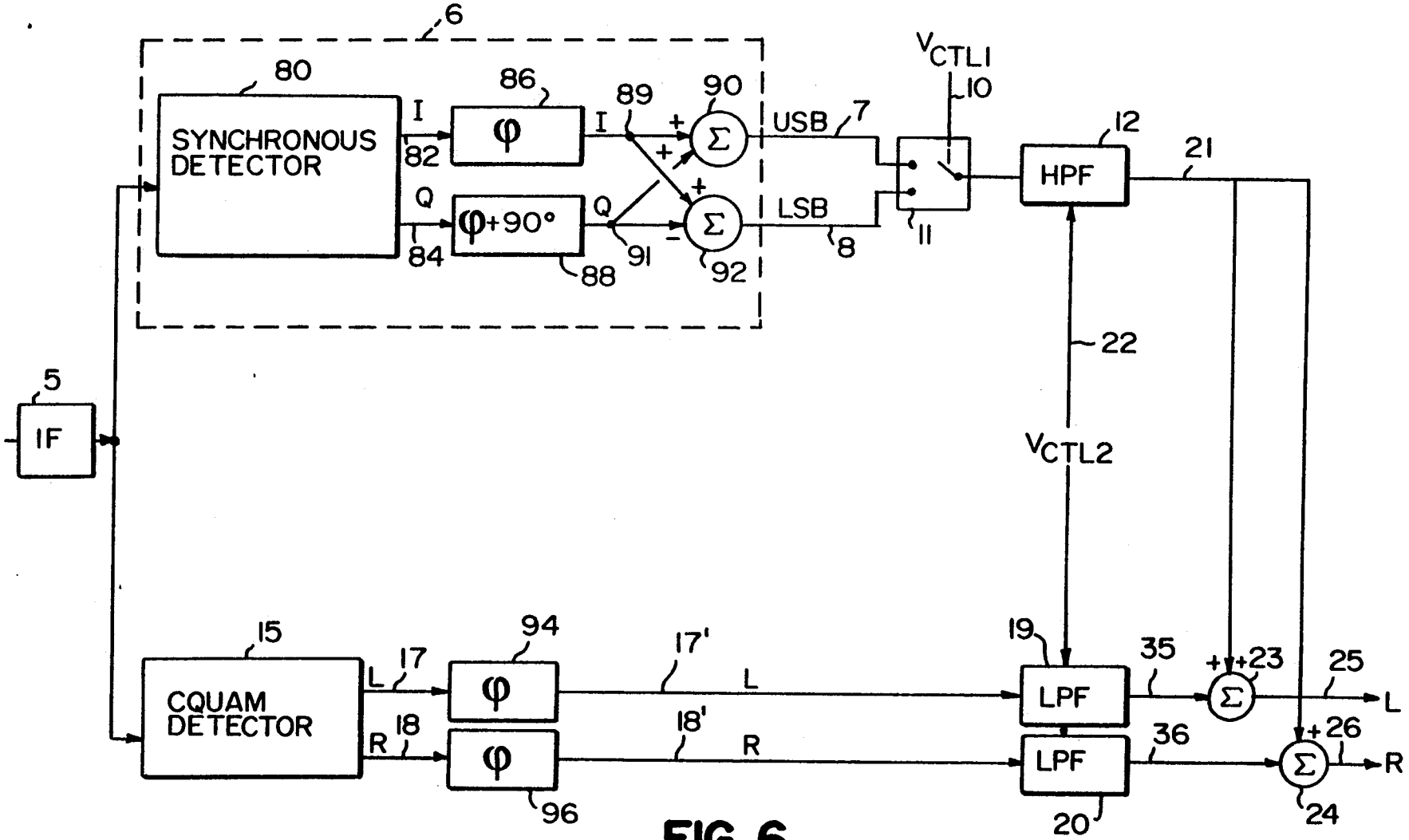
FIG. 6 is an embodiment of the receiving system of FIG. 1 incorporating a synchronous independent sideband detector.

Referring to FIG. 6, there is shown an embodiment of the receiving system of FIG. 1 incorporating a synchronous independent sideband (ISB) detector 6. The output of intermediate frequency amplifier 5 is connected to the input of a conventional synchronous detector 80 which provides an in-phase (I) audio signal on line 82 and a quadrature (Q) audio signal on line 84. The I audio signal on line 82 is connected to the input of a phase shift network 86 having a phase shift $\phi$, and the Q audio signal on line 84 is connected to the input of a phase shift network 88 having a phase shift $\phi+90°$. The phase-shifted I and Q audio signals output from phase shift networks 86 and 88, respectively, are each connected to an input of summer 90 and summer 92. Summer 90 adds the phase-shifted I and Q audio signals to reproduce the upper sideband audio signal on line 7. Summer 92 subtracts the phase-shifted Q audio signal from the phase-shifted I audio signal to reproduce the lower sideband audio signal on line 8. The left and right audio output from CQUAM detector 15 are respectively connected to the inputs of phase shift networks 94 and 96 having the same phase shift $\phi$ as phase shift network 86. The left and right phase-shifted audio outputs from phase shift networks 94 and 96 are connected to the inputs of voltage-controlled lowpass filters 19 and 20, respectively.

Referring to FIG. 7, there is shown a block diagram of an embodiment of voltage-controlled highpass filter 12 and voltage-controlled lowpass filters 19 and 20 of the receiver system of FIG. 1. Voltage-controlled lowpass filters 19 and 20 each have a second-order real pole pair controlled by voltage control signal $V_{CTL2}$ on line 22. Voltage-controlled highpass filter 12 has a first-order allpass filter 100 connected in parallel with a second-order lowpass filter 102 which has the same bandpass response as that of voltage-controlled lowpass filters 19 and 20, and is also controlled by voltage control signal $V_{CTL2}$. The output of allpass filter 100 on line 104 is connected to a noninverted input of a summer 106. The output of lowpass filter 102 is connected to an inverted input of summer 106. The output of summer 106 provides the output of voltage-controlled highpass filter 12 which is connected to summers 23 and 24 as described above.

Having described the structural arrangements, the mode of operation will be described. The present invention reduces the effects of AM interference, such as that caused by transmitting stations on adjacent frequencies. In normal AM monophonic broadcasts, the upper sideband and lower sideband carry identical information. The audio recovered from either sideband should be identical. In an AM CQUAM broadcast, the two sidebands are not identical. However, either upper sideband audio or lower sideband audio may be used as an approximation to the monophonic portion of the original broadcast. While the approximation is not perfect, it has been found to be acceptable in practice. However, in the presence of interference, it is very likely that the interference on one sideband will be quite different from the interference on the other sideband. For example, there may be an interfering station in the channel located above the carrier frequency of the desired station, but none in the channel located below the desired station. In this case, both the upper and lower sideband signals carry the same desired program audio, but the upper sideband carries noise components not found in the lower sideband.

This invention reproduces the normal CQUAM stereo signal up to some audio bandwidth chosen such that the audible effect of adjacent channel interference is minimized. Above this bandwidth, the monophonic signal from the sideband having the least interference is reproduced. The crossover frequency from stereophonic CQUAM reception to monophonic ISB reception is changed dynamically, depending on interference conditions or modulation conditions. Thus, stereophonic audio is reproduced up to as high a frequency as interference conditions allow, while wide bandwidth high fidelity reproduction through the use of monophonic ISB reception occurs above that frequency.

A conventional ISB detector is used to demodulate and separate the upper and lower sideband monophonic audio signals. Audible interference in either the upper or lower sideband audio signal is detected by an interference detector which controls an audio selector. The audio selector selects the sideband audio signal with the lowest detected interference level and passes that signal on to a variable highpass filter.

A conventional CQUAM detector is used to demodulate a full bandwidth AM stereo signal into left and right audio signal channels. These left and right audio signals are reproduced up to some audio bandwidth chosen such that the audible effect of adjacent channel interference is minimized. Audible interference in either the left or right audio signal is detected by an interference detector which sets the passband characteristic of a variable lowpass filter in each of the left and right audio signal channels, and the passband characteristic of the variable highpass filter through which the selected upper or lower monophonic audio sideband signal passes. The passband characteristics of the lowpass filters and the highpass filter complement each other to establish a variable crossover frequency, i.e., the high frequency cutoff of the lowpass filters is essentially the same as the low frequency cutoff of the highpass filter.

The left and right audio signals output from the lowpass filters are each summed with the selected upper or lower monophonic sideband audio signal output from the highpass filter to produce left and right composite audio signals. Thus, above the crossover frequency, the left and right composite audio signals each contain the monophonic signal from the sideband having the least interference. Below the crossover frequency, the left and right composite audio signals respectively contain the left and right stereophonic audio signals detected by the CQUAM detector.

In the case of strong local stations with no audible adjacent channel interference, a receiver using these principles adjusts the crossover frequency to be at or above the highest audible frequency. In this case, essentially no monophonic ISB signal is reproduced, and the full range stereophonic CQUAM left and right audio signals are reproduced. In the case of a station with significant interference on one sideband, the receiver adjusts its crossover frequency to be at or below the lowest audible frequency. In this case, essentially no stereophonic CQUAM signal is reproduced, and the full bandwidth monophonic ISB signals are reproduced. In this case, lowpass filtering can be also be applied to the ISB signal if interference is present in both sidebands. In situations between these two cases, the receiver operates as a stereophonic CQUAM receiver up to some audio crossover frequency, and as a monophonic ISB receiver above the same crossover frequency.

Referring again to FIG. 1, the improved stereophonic receiver includes conventional AM receiver topology through IF amplifier 5. This topology includes a conventional RF amplifier 2, local oscillator 4, mixer 3, and IF amplifier stage 5. The local oscillator 4 is sufficiently free of phase noise to avoid introducing audible noise in the ISB detection circuit 6.

ISB detector 6 independently detects the two sidebands present in the signal output from IF amplifier 5 in one of several well-known ways. Two common methods are the filter method and the phasing method. Both of these are outlined in reference texts, such as the ARRL Radio Amateur's Handbook. In addition, commonly available integrated circuits can be employed such as that disclosed by Kahn in U.S. Pat. No. 4,641,341. Bose et al., U.S. Pat. No. 5,008,939, dated Apr. 16, 1991, discloses another method of implementing an independent sideband detection circuit to produce the demodulated upper and lower sideband signals on lines 7 and 8, respectively.

Upper and lower sideband signals on lines 7 and 8 energize interference detector 9 which measures the amount of adjacent channel interference on each sideband, and produces control signal $V_{CTL1}$ on line 10 which causes audio selector 11 to select the audio from the upper or lower sideband having the least amount of interference at any given time. Audio selector 11 may include a fade circuit which allows for a crossfade from one audio sideband to the other as interference conditions change, thereby reducing audible artifacts associated with switching between audio sidebands. The selected audio sideband is passed through variable highpass filter 12.

The output of intermediate frequency amplifier 5 also supplies the received AM signal to a conventional CQUAM detector 15, whose left and right audio outputs on line 17 and 18 respectively, feed an interference detector 21. Interference detector 21 generates a voltage control signal $V_{CTL2}$ on line 22 which controls the crossover frequency of left and right audio lowpass filters 19 and 20, and ISB sideband audio highpass filter 12. The low frequency cutoff of highpass filter 12 reacts to control signal $V_{CTL2}$ in a complementary fashion to that of the high frequency cutoff of lowpass filters 19 and 20 to set a singular crossover frequency. The crossover frequency is controlled to minimize the audibility of the interference present at the moment while maintaining the stereo separation as much as possible.

The CQUAM left and right stereo audio signals output from lowpass filters 19 and 20, and the selected monophonic ISB upper or lower sideband signal output from highpass filter 12 are summed in summers 23 and 25 to create left and right wide bandwidth composite audio signals on lines 25 and 26, respectively, that have reduced adjacent channel interference.

The left and right composite audio signals on lines 25 and 26 may still have audible interference, such as in the case of interfering signals on both adjacent channels. In order to reduce audible interference in this case, the left and right composite audio signals on lines 25 and 26 each energize interference detector 28. Interference detector 28 measures the interference remaining in the left and right composite audio signals and generates control voltage $V_{CTL3}$ which sets the high frequency cutoff of the lowpass filters 27 and 29 to minimize the audibility of the interference at the moment. The left and right composite audio signals output from lowpass filters 27 and 29 are reproduced by conventional amplifiers 31 and 33 and loudspeakers 32 and 34, respectively.

Referring again to FIG. 2, interference detector 9 shown in the block diagram of FIG. 1, operates from the demodulated upper and lower sideband audio signals. Interference detector 9 independently examines the upper sideband audio signal on line 7 and lower sideband audio signal on line 8 for the presence of 10 kHz beat note energy (for U.S. stations having a 10 kHz channel spacing) which occurs in the presence of adjacent channel interference. The 10 kHz high-Q bandpass filters 40 and 42 pass 10 kHz beat note energy present in the lower or upper sideband audio signals, respectively. The sideband audio signal having the higher level of 10 kHz energy is also more likely to have a higher level of adjacent channel interference than the sideband having the lower level of 10 kHz energy. The level of 10 kHz energy present in the lower and upper sideband audio signal is detected by level detectors 44 and 46, respectively. The lower sideband quality signal output from level detector 44 on line 48, and the upper sideband quality signal output from level detector 46 an line 50, proportionally represent the level of 10 kHz energy in the respective sideband. Comparator 52 compares the upper and lower sideband quality signals and responds by producing control signal $V_{CTL1}$ to cause audio selector 11 to select and output the lower or upper audio sideband having the lower level of 10 kHz energy, and, thus, a lesser amount of adjacent channel interference.

Referring again to FIG. 3, interference detector 21 (28) shown in the block diagram of FIG. 1, monitors the left and right audio signals on line 17 (25) and 18 (26) output from the CQUAM detector. The maximum level of 10 kHz energy present in either the left or right audio signal determines the resulting passband characteristics of lowpass filters 19 (27) and 20 (29), and highpass filter 12, by means of voltage control signa $V_{CTL2}$ ($V_{CTL3}$). Thus, the audio signal containing the most interference determines the high frequency cutoff of the lowpass filters for both audio signals, and the matching low frequency cutoff of the highpass filter.

Similar to interference detector 9 of FIG. 2, interference detector 21 (28) includes two 10 kHz high-Q bandpass filters 40 and 42, and two level detectors 44 and 46, which detect the level of 10 kHz energy present in each of the right and left audio signals, respectively. The right audio quality signal output from level detector 44 on line 48, and the left audio quality signal output from level detector 46 an line 50, proportionally represent the level of 10 kHz energy in the respective audio signal. Maximum signal selector 53 selects the larger of the right audio quality signal on line 48 and the left audio quality signal on line 50 and passes the selected signal through nonlinear circuit 56 to produce voltage control signal $V_{CTL2}$ ($V_{CTL3}$). Nonlinear circuit 56, typically realized with a piecewise linear approximation or a continuous nonlinear circuit, determines the relationship between the selected audio quality signal on line 54 and the high frequency cutoff of lowpass filters 19 (27) and 20 (29), and the low frequency cutoff of highpass filter 12.

Referring again to FIG. 4, a closed-loop approach is used to adjust the high frequency cutoff characteristic of the lowpass filters 19 (27) and 20 (29), and the low frequency cutoff characteristic of highpass filter 12. Here, interference detector 21' (28') samples the left and right audio channels output from lowpass filters 19 (27) and 20 (29) on lines 35 (37) and 36 (38), respectively. The 10 kHz high-Q bandpass filters 40 and 42, level detectors 44 and 46, and maximum signal selector 53 operate identically to those of interference detector 21 of FIG. 3, to produce the selected audio quality signal on line 54. The measured maximum interference level represented by the selected audio quality signal on line 54 is compared by summer 58 to a preset interference level represented by DC set point voltage $V_s$ on line 6i. The preset interference level normally corresponds to an interference level that is inaudible under typical conditions. The output of summer 58 passes through a compensation circuit 62, which insures stability of the closed loop system, to produce voltage control signal $V_{CTL2}$ ($V_{CTL3}$) on line 22 (30).

If, for example, in the closed-loop system described, the high frequency cutoff of lowpass filters 19 (27) and 20 (29) is set too high, allowing audible interference to pass, the measured maximum interference on line 54 exceeds set point voltage $V_s$ on line 61, causing summer 58 to output a control voltage to compensation circuit 62. The resulting control voltage $V_{CTL2}$ ($V_{CTL3}$) output from compensation circuit 62 on line 22 (30) causes the lowpass filter high frequency cutoff to decrease in frequency to the point where the measured interference matches that of the preset interference level represented by DC set point voltage $V_s$. (As described above, $V_{CTL2}$ also affects the low frequency cutoff of high pass filter 12 so that it tracks the high frequency cutoff of lowpass filters 19 and 20.) Conventional servo design allows for a system which quickly and automatically adjusts the filter bandwidth to permit an acceptable level of interference (typically inaudible) to pass without nonlinear circuits, such as nonlinear circuits 56 in the open loop system of interference detector 21 (28) of FIG. 3.

Referring again to FIG. 5, a single interference detector 70 replaces interference detectors 9, 21 and 28 in the receiving system block diagram of FIG. 1, and offers a lower cost approach with improved performance over prior art receivers. Here, interference detector 70 samples the upper and lower sideband audio signals output from ISB detector on lines 7 and 8, respectively. The 10 kHz high-Q bandpass filters 40 and 42, and level detectors 44 and 46, operate identically to those of interference detector 9 of FIG. 2, to produce upper and lower sideband quality signals on lines 50 and 48, respectively. Comparator 52, which also operates identically to that of interference detector 9, compares the upper and lower sideband audio quality signals and responds by producing control signal $V_{CTL1}$ to control audio selector as described above.

Maximum signal selector 53, which operates identically to that of interference detector 21 of FIG. 3, selects the larger of the lower sideband audio quality signal on line 48 and the upper sideband audio quality signal on line 50 and passes the selected signal through nonlinear circuit 56 to produce voltage control signal $V_{CTL2}$. The maximum level of 10 kHz energy present in either the upper or lower audio sideband output from the ISB detector, rather than the left or right audio signal output from the CQUAM detector, determines the resulting passband characteristics of lowpass filters 19 and 20, and highpass filter 12 with voltage control signal $V_{CTL2}$. Thus, the monophonic audio sideband signal containing the most interference determines the high frequency cutoff of the lowpass filters for both the left and right stereophonic audio signals, and the matching low frequency cutoff of the monophonic highpass filter.

Minimum signal selector 72 selects the smaller of the lower sideband audio quality signal on line 48 and the upper sideband audio quality signal on line 50 and passes the selected signal through nonlinear circuit 76 to produce voltage control signal $V_{CTL3}$. The minimum level of 10 kHz energy present in either the upper or lower audio sideband output from the ISB detector, rather than maximum level present in either the left or right composite audio signals output from summers 23 and 25 of FIG. 1, determines the resulting passband characteristics of audio output stage lowpass filters 27 and 29 with voltage control signal $V_{CTL3}$. Thus, the monophonic audio sideband signal containing the least interference determines the high frequency cutoff of the lowpass filters for both the left and right composite audio signals.

Referring again to FIG. 6, ISB detector 6 uses a phasing method to recover the upper and lower monophonic audio sidebands, output on lines 7 and 8, respectively. Synchronous detector 80 recovers the I and Q audio signals from the signal output from IF amplifier 5. The I and Q signals are phase shifted 90° relative to one another by phase shift networks 86 and 88. These phase shift networks typically include allpass filters which have a flat amplitude response and an increasingly negative phase shift with frequency, but differ from one another by 90° at any given frequency. The phase shifted I and Q signals are summed by summer 90 to produce upper sideband audio signal on line 7, and subtracted by summer 92 to produce upper sideband audio signal on line 8.

Phase-shift networks 94 and 96, each having the same phase response as that of I signal phase-shift network 86, operate on the left and right stereophonic audio signals output from CQUAM detector 15. Normally, the audio signals output from a CQUAM detector require no phase shift. However, in order for the left and right stereophonic audio signals to add coherently in summers 23 and 24 with the selected monophonic sideband signal output from highpass filter 12 without incurring audio amplitude response anomalies, the left and right stereophonic audio signals are phase-shifted identically to that of the I signal. Phase-shift networks 94 and 96 provide the required phase shift for the left and right audio signals.

Any other phase shifts or time delays incurred between the selected monophonic sideband signal output from highpass filter 12 and the left and right audio signals output from lowpass filters 19 and 20 are compensated so that the audio signals summed by summers 23 and 24 add in phase at the crossover frequency of the variable highpass and lowpass filters. To this end, the response of highpass filter 12 is complementary to that of lowpass filters 19 and 20.

For example, in the case of a monophonic broadcast signal, the I signal would contain the broadcast audio, and the Q signal would be nominally zero. The resulting upper and lower sideband signals on lines 7 and 8 would be identical. The left and right audio signals output from the CQUAM detector on lines 17 and 18 would also nominally be identical and equal to the upper and lower sideband audio signals. Either the upper or lower sideband signal is added to each of the CQUAM left and right audio signals. Any amplitude variation, phase shift or time delay in the CQUAM left and right audio signals is essentially identical to that of the upper and lower sideband signal. If these parameters are not identical, the resulting sum will not have a flat amplitude response due to constructive and destructive interference of the two audio signals at various frequencies. Thus, not only are the CQUAM and ISB audio paths matched by phase networks 94 and 96, but the voltage-controlled highpass and lowpass filters are also matched and complementary such that a common signal fed to the input of both the highpass and lowpass filter will yield a signal at the output of the summer with a flat amplitude response, regardless of the crossover frequency to which the filters are set.

One class of complementary filters having acceptable performance, low cost and low complexity is the second-order filter. Another class of complementary filters having acceptable performance, albeit higher cost and complexity, is the odd-order Butterworth filters. Even-order Butterworth filters are less acceptable since the sum of even-order Butterworth filters results in a deep notch at the crossover frequency due to phase shifts in the filter response, thus making them difficult to use as complementary pairs. A first-order pair of Butterworth filters usually lacks enough rejection to provide good performance. Third-order Butterworth filters offer acceptable performance, but are more costly and complex.

Referring again to FIG. 7, voltage-controlled lowpass filters 19 and 20, and voltage-controlled highpass filter 12 implement second-order complementary filters. CQUAM left and right audio lowpass filters 19 and 20 each implement conventional voltage-controlled second-order lowpass filters having essentially identical filter responses. ISB sideband highpass filter 12 has a voltage-controlled first-order allpass filter 100 in parallel with a voltage-controlled second-order lowpass filter 102 having the same response as filters 19 and 20. The outputs of the allpass filter 102 and the lowpass filter 100 are subtracted to form a highpass filter having an amplitude response of a second-order filter with real poles, but having a different phase response. As a result, when the second-order lowpass output of filters 19 or 20 is added to the first-order highpass output of filter 12, the amplitude response is flat, even though the phase response is not flat. It will be appreciated that this approach may be extended to higher order filters as well. Voltage-controlled allpass filter 100 is designed such that the negative frequency of its pole and the positive frequency of its zero are substantially the same as the negative frequency of the pole pair of lowpass filter 102 for all values of the control voltage $V_{CTL2}$ on line 22.

Referring to FIG. 8, there is shown a block diagram of another exemplary embodiment of this invention. An AM tuner (not shown) has a CQUAM detector (15, FIG. 6) for providing left and right stereo audio signals on lines 17 and 18, respectively, and a synchronous detector (80, FIG. 6) for providing I and Q audio signals on lines 82 and 84, respectively. A bank of allpass filters 200 implement the phase-shift networks 86, 88, 94 and 96, and summers 90 and 92 of FIG. 6 to provide phase-shifted left and right audio signals on lines 17' and 18', respectively, and detected USB and LSB audio sideband signals on lines 7 and 8, respectively.

FIGS. 9(*a*) through 9(*d*) show electronic circuit schematic diagrams of an embodiment of allpass filter bank 200. FIG. 9(*a*) shows an input buffer stage 300, having an input terminal 302 and an output terminal 304 for each input on lines 17, 18, 82, and 84 of FIG. 8. FIG. 9(*b*) shows a phase-shift filter stage 310, used to implement each of the phase-shift networks 86, 88, 94 and 96 of FIG. 6. Each phase-shift filter stage 310 has an input terminal 312, for connection to output terminal 304 of a corresponding input buffer stage 300, and an output terminal 314 providing the phase-shifted signal. A variable resistor 306 in input stage 300 adjusts the gain of the input stage and is set so that 30% modulation produces a 1 $V_{rms}$ signal level at the output 314 of the corresponding phase-shift filter stage 310.

Table 1 of FIG. 9(*b*) shows two sets of component values for the phase-shift filter stage 310. The first set of component values implements each of phase-shift networks 86, 94 and 96. The second set of component values implements phase-shift network 88, which has an additional 90° phase-shift relative to the other phase shift networks.

FIG. 9(c) shows a summer circuit, corresponding to summer 90 of FIG. 6, for summing the I and Q audio signals output from phase-shift filter stages 310, corresponding to phase shift networks 86 and 88, respectively, to produce the USB audio signal on line 7. FIG. 9(*d*) shows a circuit, corresponding to summer 92 of FIG. 6, for taking the difference of the I and Q audio signals output from phase shift filter stages 310, corresponding to phase shift networks 86 and 88, respectively, to produce the LSB audio signal on line 8.

FIGS. 10 and 12 show a detailed block diagram of an exemplary embodiment of interference detector 70 of FIG. 8 (and FIG. 5). FIG. 11(*a*) shows an electronic circuit schematic diagram of an exemplary embodiment of a fourth-order Butterworth bandpass filter having a $Q=50$ and center frequency $f_o$, for implementing the 10 kHz bandpass filters 40 and 42 of interference detector 70.

Referring again to FIG. 10, interference level detectors 44 and 46 each include an average level detector 500 and a 1.2 Hertz lowpass filter 502, for which an electronic circuit schematic diagram is shown in FIG. 11(*b*). Max sideband quality signal on line 54, output from Max quality detector 53 (FIG. 10), is input to divider circuit 600. A schematic diagram of an electronic circuit of an embodiment of Max quality detector 53 is shown in FIG. 11(*c*).

Referring also to FIG. 12, the USB quality signal on line 48 and the LSB quality signal on line 50 are each fed to an input of comparator 52 which provides control signal $V_{CTL1}$ on line 10. Control signal $V_{CTL1}$ on line 10 feeds the input to sideband selector 11, which is shown here implemented as a crossfade circuit for gradually switching between the upper sideband and the lower sideband audio signals, and thus reducing switching noise at the output of sideband selector 11 on line 14. Comparator 52, implemented as a 3 dB hysteresis comparator, produces a logic level for control signal $V_{CTL1}$ on line 10, which is fed on line 505 to a first integrator 506, whose output on line 509 controls voltage-controlled amplifier 508. USB audio signal on line 7 is input to voltage-controlled amplifier 508 which in turns outputs an amplitude-adjusted upper sideband audio signal on line 513 dependent on the control signal on line 509. Control signal $V_{CTL1}$ on line 10 is also fed through a digital inverter 504 whose output on line 507 is input to a second integrator 512, whose output on line 511 controls a second voltage-controlled amplifier 516. LSB audio signal on line 8 is input to voltage-controlled amplifier 516 which in turns outputs an amplitude-adjusted upper sideband audio signal on line 515 dependent on the control signal on line 511. A signal summer 510 sums the amplitude-adjusted USB audio signal on line 513 with the amplitude-adjusted LSB audio signal on line 515 to provide the selected audio sideband at the output of summer 510 on line 14.

FIGS. 13(*a*)–13(*d*) show electronic circuit schematic diagrams of an embodiment of the comparator 52 and crossfade sideband selector 11 shown in FIG. 12. FIG. 13(*a*) shows comparator 52 having USB quality signal input on line 48 and LSB quality signal input on line 50, and providing noninverted control signal $V_{CTL1}$ on line 505, and an inverted version of that signal on line 507. FIG. 13(*b*) shows an integrator circuit for implementing either integrator 506 or 512, having an input on line 505 (507) and an output on line 509 (511). FIG. 13(*c*) shows a voltage-controlled amplifier circuit for implementing either voltage-controlled amplifier 508 or 516, having a sideband audio input on line 7 (8), and an amplitude-adjusted sideband audio output signal on line 513 (515) whose amplitude is controlled by the integrator output signal on line 509 (511). FIG. 13(*d*) shows a circuit of sideband signal summer 510 for summing the output of voltage-controlled amplifier 508 on line 513 with the output of voltage-controlled amplifier 516 on line 515 to provide the selected sideband output signal on line 14.

Referring again to FIG. 12, there is shown a block diagram of an embodiment of the nonlinear circuit 56 of interference detector 70 for producing filter control signal $V_{CTL2}$ on line 22. Max sideband quality signal on line 54, output from Max quality detector 53 (FIG. 10), is input to divider circuit 600. The divider circuit creates the desired nonlinear relationship between input and output by dividing a constant voltage by the input voltage. The resulting quotient is put out as a voltage on line 602, which is fed through gain and offset circuit 604, whose output on line 606 is fed one input of maximum signal detector 608. The output of divider circuit 600 on line 602 is fed through gain and offset circuit 604, whose output on line 606 is fed to one input of a maximum signal detector 608. A preset DC voltage level on line 610 energizes the other input of maximum signal detector 608. Maximum signal detector 608 compares the signal level on line 606 with the DC voltage level on line 610, and selects the larger of the two signals for output as $V_{CTL2}$ on line 22. FIG. 14 shows an electronic circuit schematic diagram of an embodiment of divider circuit 600 and gain and offset circuit 604.

Referring to FIG. 15, there is shown the block diagram of an embodiment of $V_{CTL3}$ generator 700 of interference detector 70 of the embodiment of FIG. 8. Max sideband quality signal on line 54 is input to nonlinear circuit 702 whose output on line 706 is input to one input of Min/Max signal selector 710. FIG. 16(*a*) shows an electronic circuit schematic diagram for an embodiment of nonlinear circuit 702. An AGC signal $V_{AGC}$, representative of the RF signal level at the tuner, is input to nonlinear circuit 704 on line 701. The output of nonlinear circuit 704 on line 708 drives another input of Min/Max detector 710. FIG. 16(*b*) shows a circuit diagram for nonlinear circuit 704. FIG. 16(*c*) shows an electronic circuit schematic diagram for Min/Max selector 710 having one input on line 706 from nonlinear circuit 702, another input on line 708 from nonlinear circuit 704, and an output on line 715. The output from Min/Max selector 710 on line 715 drives a fast decay/slow attack level adjusting circuit 714, which provides control signal $V_{CTL3}$ on line 30.

Referring to FIG. 17(*a*), there is shown an electronic circuit schematic diagram of an embodiment of either voltage-controlled lowpass filter 19 or 20 of FIG. 8. This circuit implements the second-order lowpass filter shown in FIG. 7. Lowpass filter 19 (20) has left or right stereo audio input on line 17' (18'), the corresponding left or right filtered stereo output on line 35 (36), and control signal $V_{CTL\,2}$ input to the circuit on line 22.

Referring to FIG. 17(*b*), there is shown an electronic circuit schematic diagram of an embodiment of voltage-controlled highpass filter 12 of FIG. 8. This circuit implements the voltage-controlled highpass filter 12 of FIG. 7 having a first-order allpass filter 100 from which a second-order lowpass filter 102 is subtracted. The second-order lowpass filter section 102 is essentially the same lowpass filter as that shown in FIG. 17(*a*) and is controlled by control signal $V_{CTL2}$ input on line 22, and is adjusted to have a frequency cutoff $f_o = 10$ kHz when control signal $V_{CTL2}$ indicates that a maximum allowable noise level is detected on the selected sideband audio signal. The first-order allpass filter is constructed from the first section of the second-order lowpass filter. If the input voltage is subtracted from twice the output voltage of the first section of the lowpass filter, the result is a first-order allpass filter with the same frequency as the low pass. This subtraction operation is performed in the same summing amplifier that subtracts second-order lowpass filter output from the allpass filter output.

FIG. 17(*c*) shows an electronic circuit schematic diagram of an embodiment of either summer 23 or 24 of FIG. 8, having the filtered left or right stereo audio output from voltage-controlled lowpass filter 19 (20) on line 35 (36) as one input to the circuit, and the filtered selected sideband signal output from voltage-controlled highpass filter 12 on line 21 as a second input to the circuit. The summed composite left or right stereo audio output appears on line 25 (26).

FIG. 18 shows an electronic circuit schematic diagram of an embodiment of either voltage-controlled lowpass filter 27 or 29 of FIG. 8. Lowpass filter 27 (29) has composite left or right stereo audio output from summer 23 (24) on line 25 (26) as input, the corresponding left or right filter stereo output on line 748 (749), and control signal $V_{CTL3}$ on line 30.

FIG. 19(*a*) shows an electronic circuit schematic diagram of an embodiment of birdie filters 750 and 752 shown in the audio output stage of FIG. 8, for removing any residual 10 kHz energy in the composite left and right stereo audio signals, respectively, at the output stage of the receiver. FIG. 19(*b*) shows an electronic circuit schematic diagram of an embodiment for either left or right stereo audio output amplifier 754 or 756 of FIG. 8, respectively.

FIG. 20 shows a block diagram illustrating the logical arrangement of a crossfade ISB sideband selector. In the manner described above, 10 kHz bandpass filters 40 and 42 and level detectors 44 and 46 detect the interference signals on lower sideband line 8 and upper sideband line 7, respectively. These interference level signals on outputs 48 and 50, respectively, are differentially combined to provide a cotnrol signal on line 10 to move the wiper arm 14 of a potentiometer 51 functioning as a director connected across the USB and LSB lines. As the interference level in one sideband increases, the wiper arm moves to pass less of the audio signal from that sideband and more of the audio signal from the other sideband to the ISB output line 14. Other techniques may be used to combine the two sideband audio signals under the control of control signal $V_{CTL1}$, such as two voltage-controlled gain blocks and a summing circuit.

Other embodiments are within the claims.

We claim:

1. A receiver for receiving a stereophonic signal with upper and lower sidebands carrying a modulating audio signal, said receiver comprising, independent sideband circuitry for providing upper and lower sideband signals, selector circuitry responsive to the level of audible noise in each said upper and lower sideband signal for selecting that one of said sideband signals having a lower level of audible noise relative to the other, an ISB highpass filter for filtering said that one of said sideband signals and producing a highpass filtered sideband signal, stereo detector circuity for providing left and right stereophonic audio signals, at least one audio lowpass filter for filtering each said left and right stereophonic audio signals and producing corresponding lowpass filtered left and right stereophonic audio signals, and at least one signal combiner for combining said highpass filtered sideband signal with each said lowpass filtered left and right stereophonic audio signals to produce corresponding composite left and right audio signals.

2. The receiver as claimed in claim 1, wherein said selector circuitry comprises, prefilter circuits responsive to said upper and lower sideband signals for providing corresponding upper and lower sideband quality signals representing the level of audible noise present in said upper and lower sideband signals respectively, a signal comparator responsive to the level of said upper and lower sideband quality signals for providing a logic control signal having one of at least two states representative of that one of said sideband quality signals having a signal level greater than the other, and a switch for providing one of said upper and said lower sideband signals in response to the state of said logic control signal.

3. The receiver as claimed in claim 2 wherein said prefilters comprise high-Q bandpass filters centered at a frequency corresponding to the separation between carrier frequencies of adjacent channels.

4. The receiver as claimed in claim 2 wherein said switch comprises a crossfade circuit.

5. The receiver as claimed in claim 4 wherein said crossfade circuit comprises, at least one variable gain amplifier for amplifying each of said upper and lower sideband signals, said variable gain amplifiers each having a gain responsive to control signals related to said upper and lower sideband quality signals, and a summer for combining the outputs of said variable gain amplifiers.

6. The receiver as claimed in claim 5, wherein said crossfade circuit further comprises, a logic device responsive to said sideband quality signals for providing said control signals, and at least one integrator for integrating said control signals for controlling said variable gain amplifiers.

7. The receiver as claimed in claim 1, wherein the low frequency cutoff of said ISB highpass filter and the high frequency cutoff of said at least one audio lowpass filter are at substantially the same frequency that is a crossover frequency.

8. The receiver as claimed in claim 7, wherein said ISB highpass filter further comprises a variable highpass filter having a low frequency cutoff responsive to a first control signal, said audio lowpass filter further comprises a variable lowpass filter having a high frequency cutoff responsive to said first control signal, and said receiver further comprises a first interference detector for detecting audible noise in each said left and right stereophonic audio signals output from said stereo detector and providing said first control signal responsive to said audible noise detected such that said high frequency cutoff of said at least one audio lowpass filter reduces said audible noise in each said filtered left and right stereophonic audio signals output from said audio lowpass filter.

9. The receiver as claimed in claim 8, wherein said ISB highpass filter and said audio lowpass filter comprise a complementary pair of variable second-order filters.

10. The receiver as claimed in claim 9, wherein said audio lowpass filter comprises a first variable second-order lowpass filter with real poles, said ISB highpass filter comprises an allpass filter in parallel with a second variable second-order lowpass filter with real poles having the same filter characteristic as said first variable second-order lowpass filter with real poles, and a differential signal combiner for subtracting said second variable second-order lowpass filter with real poles from said variable allpass filter.

11. The receiver as claimed in claim 8, wherein said first interference detector further comprises, prefilter circuits responsive to said left and right stereophonic audio signals for providing corresponding left and right audio quality signals representing the level of audible noise present in said left and right stereophonic audio signal respectively, a maximum signal selector responsive to the level of said left and right audio quality signals for selecting that one of said left and right audio quality signals having a signal level greater than the other, and a signal convertor for converting that one of said selected left and right audio quality signals into said first control signal.

12. The receiver as claimed in claim 11 wherein said prefilters comprise 10 kHz high-Q bandpass filters centered at a frequency corresponding to the separation between carrier frequencies of adjacent channels.

13. The receiver as claimed in claim 11 wherein said signal convertor comprises a nonlinear circuit.

14. The receiver as claimed in claim 7, wherein said ISB highpass filter further comprises a variable highpass filter having a low frequency cutoff responsive to a first control signal, said audio lowpass filter further comprises a variable lowpass filter having a high frequency cutoff responsive to said first control signal, and said receiver further comprises a first interference detector for detecting audible noise in each said lowpass filtered left and right stereophonic audio signals output from said at least one audio lowpass filter for providing said first control signal responsive to said audible noise detected such that said high frequency cutoff of said at least one audio lowpass filter reduces said audible noise in each said lowpass filtered left and right stereophonic audio signals.

15. The receiver as claimed in claim 14 wherein said first interference detector further comprises, prefilter circuits responsive to said lowpass filtered left and right stereophonic audio signals for providing corresponding left and right audio quality signals representing the level of audible noise present in said lowpass filtered left and right stereophonic audio signals respectively, a maximum signal selector responsive to the level of said left and right audio quality signals for selecting that one of said left and right audio quality signals having a signal level greater than the other, and a signal convertor for converting that one of said selected left and right audio quality signals into said first control signal.

16. The receiver as claimed in claim 15 wherein said prefilters comprise high-Q bandpass filters centered at a frequency corresponding to the separation between carrier frequencies of adjacent channels.

17. The receiver as claimed in claim 15 wherein said signal convertor comprises, the source of a present level signal representing an acceptable level of interference, a set point comparator for comparing the level of that one said left and right audio quality signals to said preset level signal for providing said first control signal responsive to the difference between said that one of said audio quality signals and said present level signal.

18. The receiver as claimed in claim 15 wherein said first interference detector comprises, a closed-loop circuit with a closed-loop response, and a compensation circuit for stabilizing the closed-loop response.

19. A receiver for receiving a stereophonic signal with upper and lower sidebands carrying a modulating audio signal, said receiver comprising, independent sideband circuitry for providing upper and lower sideband audio signals, a source of first and second control signals, selector circuitry for selecting said upper or lower sideband audio signal responsive to the first control signal, a variable highpass filter having a low frequency cutoff responsive to the second control signal for filtering said selected sideband signal and producing a highpass filtered sideband signal, stereo detector circuitry for providing left and right stereophonic audio signals, at least one variable lowpass filter having a high frequency cutoff responsive to said second control signal for filtering each said left and right stereophonic audio signals and producing corresponding lowpass filtered left and right stereophonic audio signals, interference detecting circuitry comprising said source of first and second control signals for detecting audible noise in each said upper and lower sideband audio signals output from said independent sideband circuitry for providing said first and second control signals responsive to the level of audible noise in each said upper and lower sideband audio signal such that said selector circuitry selects that one of said upper and lower sideband audio signals having the lower level of audible noise relative to the other and said high frequency cutoff of each said variable lowpass filter reduces the level of audible noise in each said filtered left and right stereophonic audio signals output from said at least one audio lowpass filter and the low frequency cutoff of said highpass filter is at substantially the same frequency as the high frequency cutoff of said lowpass filter, and at least one signal combiner for combining said highpass filtered sideband signal with each said lowpass filtered left and right stereophonic audio signals to produce corresponding composite left and right audio signals.

20. The receiver as claimed in claim 19, wherein said interference detector comprises, prefilter circuits responsive to said upper and lower sideband audio signals for providing corresponding upper and lower sideband audio quality signals representing the level of audible noise present in each said upper and lower sideband audio signals respectively, a signal comparator responsive to the level of said upper and lower sideband quality signals for providing said first control signal, said first control signal having one of at least two states representative of that one of said sideband quality signals having a signal level greater than the other, a maximum signal selector responsive to the level of said upper and lower sideband quality signals for selecting that one of said upper or lower sideband quality signals having a signal level greater than the other, and a signal convertor for converting that one of said sideband quality signals into said second control signal.

21. The receiver of claim 20 wherein said selector circuitry comprises, a switch for providing a selected one of said upper and said lower sideband signals in response to the state of said first control signal.

22. The receiver as claimed in claim 20 wherein said prefilters comprise high-Q bandpass filters centered at a frequency corresponding to the separation between carrier frequencies of adjacent channels.

23. The receiver as claimed in claim 20 wherein said signal convertor comprises a nonlinear circuit.

24. The receiver as claimed in claim 19, wherein said variable highpass filter and said at least one variable lowpass filter comprise a complementary pair of variable second-order filters.

25. The receiver as claimed in claim 24, wherein said at least one variable lowpass filter comprises a first variable second-order lowpass filter real poles, and said variable highpass filter comprises an allpass filter in parallel with a second variable second-order lowpass filter with real poles having the same filter characteristic as said first variable second-order lowpass filter with real poles, and a differential signal combiner for subtracting the output of said second variable second-order lowpass filter with real poles from that of said allpass filter.

26. The receiver as claimed in claim 19 further comprising, a source of a third control signal, at least one second variable lowpass filter having a high frequency cutoff responsive to the third control signal for filtering each said composite left and right stereophonic audio signals and producing corresponding lowpass filtered composite left and right stereophonic audio signals, said interference detector further comprises said source of a third control signal and a minimum signal selector responsive to the level of said upper and lower sideband quality signals for selecting that one of said upper and lower sideband quality signals having a signal level less than the other sideband quality signal, and a second signal convertor for converting that one of said sideband quality signals selected by said minimum signal selector into said third control signal.

27. The receiver as claimed in claim 26 wherein said second signal convertor comprises a nonlinear circuit.

28. The receiver as claimed in claim 26 wherein said receiver includes a source of a fourth control signal representative of the level of the received RF signal and said second signal convertor is also responsive to said fourth control signal.

29. The receiver as claimed in claim 26, wherein said second variable lowpass filter comprises a variable third-order Butterworth lowpass filter.

30. An amplitude modulation receiver comprising, stereo detector circuitry for providing left and right stereo signals, and filtering and combining circuitry for selectively transmitting spectral components of the left and right stereo signals below a predetermined audio cutoff frequency to form left and right low frequency stereo portions respectively of left and right composite signals respectively, transmitting spectral components of a monophonic audio signal above said predetermined audio cutoff frequency to form a monophonic high frequency signal that forms high frequency portions of said left and right composite signals and combining said monophonic high frequency signal with said left and right low frequency portions respectively to provide said left and right composite signals.

31. A receiver in accordance with claim 30 and further comprising, a controller for establishing said predetermined cutoff frequency in response to the level of noise received by said receiver to the highest frequency consistent with a substantially inaudible noise level in said left and right composite signals to maintain a high degree of stereo separation in the presence of otherwise audible noise while said left and right composite signals form a high fidelity stereo signal.

32. A receiver in accordance with claim 31 wherein said receiver includes a tuner for selectively receiving a selected amplitude modulated signal on a carrier in a channel in a broadcast band separated from the frequency of a carrier in an adjacent channel by a predetermined separation frequency and said filtering and combining circuitry comprises, a band reject filter for rejecting spectral components substantially at said separation frequency from said left and right composite signals.

33. A receiver in accordance with claim 30 and further comprising, an independent sideband selector responsive to a received amplitude modulated signal having upper and lower sidebands to provide that one of said sidebands having lesser noise signal energy, said that one of said sidebands being coupled to said filtering and combining circuitry to provide the monophonic high frequency signal.

34. A receiver in accordance with claim 31 and further comprising, an independent sideband selector responsive to a received amplitude modulated signal having upper and lower sidebands to provide that one of said sidebands having lesser noise signal energy, said that one of said sidebands being coupled to said filtering and combining circuitry to provide the monophonic high frequency signal.

35. A receiver in accordance with claim 32 and further comprising, an independent sideband selector responsive to a received amplitude modulated signal having upper and lower sidebands to provide that one of said sidebands having lesser noise signal energy, said that one of said sidebands being coupled to said filtering and combining circuitry to provide the monophonic high frequency signal.

36. The receiver as claimed in claim 1, where in said selector circuitry comprises, prefilter circuits responsive to said upper and lower sideband signals for providing corresponding upper and lower sideband quality signals representing the level of audible noise present in said upper and lower sideband signals respectively, a signal comparator responsive to the level of said upper and lower sideband quality signals for providing a control signal representative of the level of one of said sideband quality signals relative to the other, and a director for directing said upper and lower sideband signals to an output line in relative proportion dependent upon said control signal.

37. The receiver as claimed in claim 36 wherein said director comprises a crossfade circuit.

* * * * *

UNITED STATES PATENT AND TRADEMARK OFFICE

CERTIFICATE OF CORRECTION

PATENT NO. : 5,253,298

DATED : October 12, 1993

INVENTOR(S) : Robert P. Parker et al.

It is certified that error appears in the above-identified patent and that said Letters Patent is hereby corrected as shown below:

Column 5, lines 2-3, "Characteristics" should read --characteristics--.

Column 6, line 25, "2i" should read --21--.

Column 10, line 51, "signa" should read --signal--.

Column 11, line 22, "6i" should read --61--.

Column 11, lines 64-65, after "selector" insert --11--.

Column 17, line 6, "cotnrol" should read --control--.

Signed and Sealed this

Sixteenth Day of August, 1994

Bruce Lehman

*Attest:*

BRUCE LEHMAN

*Attesting Officer*

*Commissioner of Patents and Trademarks*